US010642208B2

(12) United States Patent
Eguchi et al.

(10) Patent No.: US 10,642,208 B2
(45) Date of Patent: May 5, 2020

(54) IMAGE FORMING APPARATUS WITH ABNORMALITY DIAGNOSIS, IMAGE FORMING SYSTEM WITH ABNORMALITY DIAGNOSIS, AND CONTROL PROGRAM OF IMAGE FORMING APPARATUS WITH ABNORMALITY DIAGNOSIS

(71) Applicant: KONICA MINOLTA, INC., Tokyo (JP)

(72) Inventors: Hiroshi Eguchi, Toyohashi (JP); Natsuyo Ida, Toyokawa (JP); Junichi Masuda, Toyokawa (JP); Masahiro Nonoyama, Toyokawa (JP); Akimasa Ishikawa, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/285,276

(22) Filed: Feb. 26, 2019

(65) Prior Publication Data

US 2019/0302671 A1 Oct. 3, 2019

(30) Foreign Application Priority Data

Mar. 27, 2018 (JP) ..... 2018-059496

(51) Int. Cl.
*G03G 15/00* (2006.01)

(52) U.S. Cl.
CPC ..... *G03G 15/55* (2013.01)

(58) Field of Classification Search
None
See application file for complete search history.

(56) References Cited

U.S. PATENT DOCUMENTS

2016/0147187 A1* 5/2016 Muramoto ..... G03G 15/5062 399/9
2017/0266885 A1* 9/2017 Gifford ..... B29C 64/209

FOREIGN PATENT DOCUMENTS

JP 2009075370 A 4/2009

* cited by examiner

*Primary Examiner* — Victor Verbitsky
(74) *Attorney, Agent, or Firm* — Buchanan Ingersoll & Rooney PC

(57) ABSTRACT

An image forming apparatus includes: a first rotor and a second rotor that are each a rotatable member; a first movable member including the first rotor or a transferer that transfers power of the first rotor to another member; a second movable member including the second rotor or a transferer that transfers power of the second rotor to another member; a hardware processor that drives simultaneously the first rotor and the second rotor at mutually different numbers of revolutions or speeds, and performs abnormality diagnosis on the first movable member and the second movable member, based on the sounds of operation acquired by the sound acquirer; and a sound acquirer that acquires sounds of operation of the first movable member and the second movable member with the first rotor and the second rotor being driven by the hardware processor.

15 Claims, 15 Drawing Sheets

| SEQUENCE OF ABNORMALITY DIAGNOSIS | FIRST MOVABLE MEMBER TO BE DIAGNOSED | FIRST ROTOR TO BE DRIVEN | SECOND MOVABLE MEMBER TO BE DIAGNOSED | SECOND ROTOR TO BE DRIVEN |
|---|---|---|---|---|
| 1 | FAN 51a | FAN 51a | FAN 51b | FAN 51b |
| 2 | FAN 51c | FAN 51c | FAN 51d | FAN 51d |
| 3 | FAN 51e | FAN 51e | | |

FIG. 9

| SEQUENCE OF ABNORMALITY DIAGNOSIS | FIRST MOVABLE MEMBER TO BE DIAGNOSED | FIRST ROTOR TO BE DRIVEN | SECOND MOVABLE MEMBER TO BE DIAGNOSED | SECOND ROTOR TO BE DRIVEN |
|---|---|---|---|---|
| 1 | MOTOR 52a | MOTOR 52a | MOTOR 52b | MOTOR 52b |
| 2 | MOTOR 52c | MOTOR 52c | MOTOR 52d | MOTOR 52d |
| 3 | MOTOR 52e | MOTOR 52e | MOTOR 52f | MOTOR 52f |
| 4 | MOTOR 52g | MOTOR 52g | MOTOR 52h | MOTOR 52h |
| 5 | MOTOR 52i | MOTOR 52i | MOTOR 52j | MOTOR 52j |
| 6 | MOTOR 52k | MOTOR 52k | MOTOR 52l | MOTOR 52l |
| 7 | MOTOR 52m | MOTOR 52m | MOTOR 52n | MOTOR 52n |
| 8 | MOTOR 52o | MOTOR 52o | | |

FIG. 11

| SEQUENCE OF ABNORMALITY DIAGNOSIS | FIRST MOVABLE MEMBER TO BE DIAGNOSED | FIRST ROTOR TO BE DRIVEN | SECOND MOVABLE MEMBER TO BE DIAGNOSED | SECOND ROTOR TO BE DRIVEN |
|---|---|---|---|---|
| 1 | MOTOR 52a | MOTOR 52a | MOTOR 52b | MOTOR 52b |
| 2 | MOTOR 52c | MOTOR 52c | CLUTCH 53a | MOTOR 52b |
| 3 | MOTOR 52d | MOTOR 52d | CLUTCH 53b | MOTOR 52b |
| 4 | MOTOR 52e | MOTOR 52e | CLUTCH 53c | MOTOR 52b |
| 5 | CLUTCH 53h | MOTOR 52e | CLUTCH 53d | MOTOR 52b |
| 6 | MOTOR 52f | MOTOR 52f | CLUTCH 53e | MOTOR 52b |
| 7 | MOTOR 52g | MOTOR 52g | CLUTCH 53f | MOTOR 52b |
| 8 | MOTOR 52h | MOTOR 52h | CLUTCH 53g | MOTOR 52b |
| 9 | MOTOR 52i | MOTOR 52i | SOLENOID 54 | MOTOR 52b |
| 10 | MOTOR 52j | MOTOR 52j | MOTOR 52k | MOTOR 52k |
| 11 | MOTOR 52l | MOTOR 52l | MOTOR 52m | MOTOR 52m |
| 12 | MOTOR 52n | MOTOR 52n | MOTOR 52o | MOTOR 52o |
| ... | ... | ... | ... | ... |

FIG. 14

| DATE | TIME | SHEET FEEDING PORT | SHEET | SIZE |
|---|---|---|---|---|
| X. X, 20XX | 8:05 | FIRST STAGE | PLAIN PAPER | A4Y |
| X. X, 20XX | 9:30 | FIRST STAGE | PLAIN PAPER | A4Y |
| X. X, 20XX | 9:45 | SECOND STAGE | PLAIN PAPER | A4T |
| X. X, 20XX | 10:03 | MANUAL | THICK PAPER | A4Y |
| X. X, 20XX | 11:11 | FIRST STAGE | PLAIN PAPER | A4Y |
| X. X, 20XX | 12:02 | FIRST STAGE | PLAIN PAPER | A4Y |
| X. X, 20XX | 14:25 | FIRST STAGE | PLAIN PAPER | A4Y |
| X. X, 20XX | 16:10 | FIRST STAGE | PLAIN PAPER | A4Y |
| X. X, 20XX | 16:12 | FIRST STAGE | PLAIN PAPER | A4Y |

IMAGE FORMING APPARATUS WITH ABNORMALITY DIAGNOSIS, IMAGE FORMING SYSTEM WITH ABNORMALITY DIAGNOSIS, AND CONTROL PROGRAM OF IMAGE FORMING APPARATUS WITH ABNORMALITY DIAGNOSIS

The entire disclosure of Japanese patent Application No. 2018-059496, filed on Mar. 27, 2018, is incorporated herein by reference in its entirety.

BACKGROUND

Technological Field

The present invention relates to an image forming apparatus, an image forming system, and a control program of the image forming apparatus. More particularly, the present invention relates to an image forming apparatus that performs abnormality diagnosis on a movable member on the basis of the sound of operation, an image forming apparatus, and a control program of the image forming apparatus.

Description of the Related Art

Examples of an electrophotographic image forming apparatus include: a multi function peripheral (MFP) having a scanner function, a facsimile function, a copier function, a printer function, a data-communication function, and a server function, a facsimile, a copier, and a printer.

As a technique of performing abnormality diagnosis on an image forming apparatus, there is a technique of performing abnormality diagnosis on the basis of sound generated in operation of each movable member in an image forming apparatus. Examples of a technique of performing abnormality diagnosis on the basis of sound, include a technique of performing abnormality diagnosis while operating each movable member (e.g., a motor or a fan) in an operation mode identical to that in practical printing, and a technique of making a transition to another mode different from an operation mode in practical printing and performing abnormality diagnosis while operating each movable member in sequence in the another mode.

JP 2009-75370 A discloses a technique of performing abnormality diagnosis while operating each movable member in sequence in another mode. In JP 2009-75370 A, while operating almost all of a plurality of operation components for forming an image on a recording medium, singly or sequentially, a person in charge of maintenance checks whether an abnormal sound is generated in driving of any of the operation components.

For the technique in JP 2009-75370 A, because abnormality diagnosis is performed in sequential operation of movable members included in an image forming apparatus, the time required for abnormality diagnosis lengthens as the number of movable members included in the image forming apparatus increases, resulting in low convenience.

Performance of abnormality diagnosis in simultaneous operation of a plurality of movable members for shortening the time required for abnormality diagnosis, causes large dependence on the hearing of a maintenance checker for the abnormality diagnosis, resulting in a deterioration in the reliability of abnormality diagnosis. That is, because the plurality of movable members included in the image forming apparatus operates generally at mutually close numbers of revolutions or speeds, respective sounds generated from the plurality of movable members are more likely to be similar. Thus, performance of abnormality diagnosis in simultaneous operation of the plurality of movable members, causes the maintenance checker to have difficulty in specifying a movable member that is the source of an abnormal sound, on the basis on a heard sound.

SUMMARY

The present invention has been made in order to solve the problems, and an object of the present invention is to provide an image forming apparatus enabling improvement of the convenience of abnormality diagnosis, an image forming system, and a control program of the image forming apparatus.

To achieve the abovementioned object, according to an aspect of the present invention, an image forming apparatus reflecting one aspect of the present invention comprises: a first rotor and a second rotor that are each a rotatable member; a first movable member including the first rotor or a transferer that transfers power of the first rotor to another member; a second movable member including the second rotor or a transferer that transfers power of the second rotor to another member; a hardware processor that drives simultaneously the first rotor and the second rotor at mutually different numbers of revolutions or speeds, and performs abnormality diagnosis on the first movable member and the second movable member, based on the sounds of operation acquired by the sound acquirer; and a sound acquirer that acquires sounds of operation of the first movable member and the second movable member with the first rotor and the second rotor being driven by the hardware processor.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 9 is a table of the order of movable members in which the CPU performs abnormality diagnosis in a motor diagnosis mode according to the embodiment of the present invention;

FIG. 11 is a table of the order of movable members in which the CPU performs abnormality diagnosis in an entire load diagnosis mode according to the embodiment of the present invention;

FIG. 14 illustrates a printing history table stored in a ROM in a third modification of the embodiment of the present invention;

DETAILED DESCRIPTION OF EMBODIMENTS

Hereinafter, one or more embodiments of the present invention will be described with reference to the drawings. However, the scope of the invention is not limited to the disclosed embodiments.

A case where an image forming apparatus is an MFP, will be described in the following embodiment. The image forming apparatus may be a facsimile, a copier, or a printer for color printing or monochrome printing, instead of the MFP.

Schematic Configuration of Image Forming Apparatus

First, the schematic configuration of the image forming apparatus according to the present embodiment, will be described.

Figure 1:
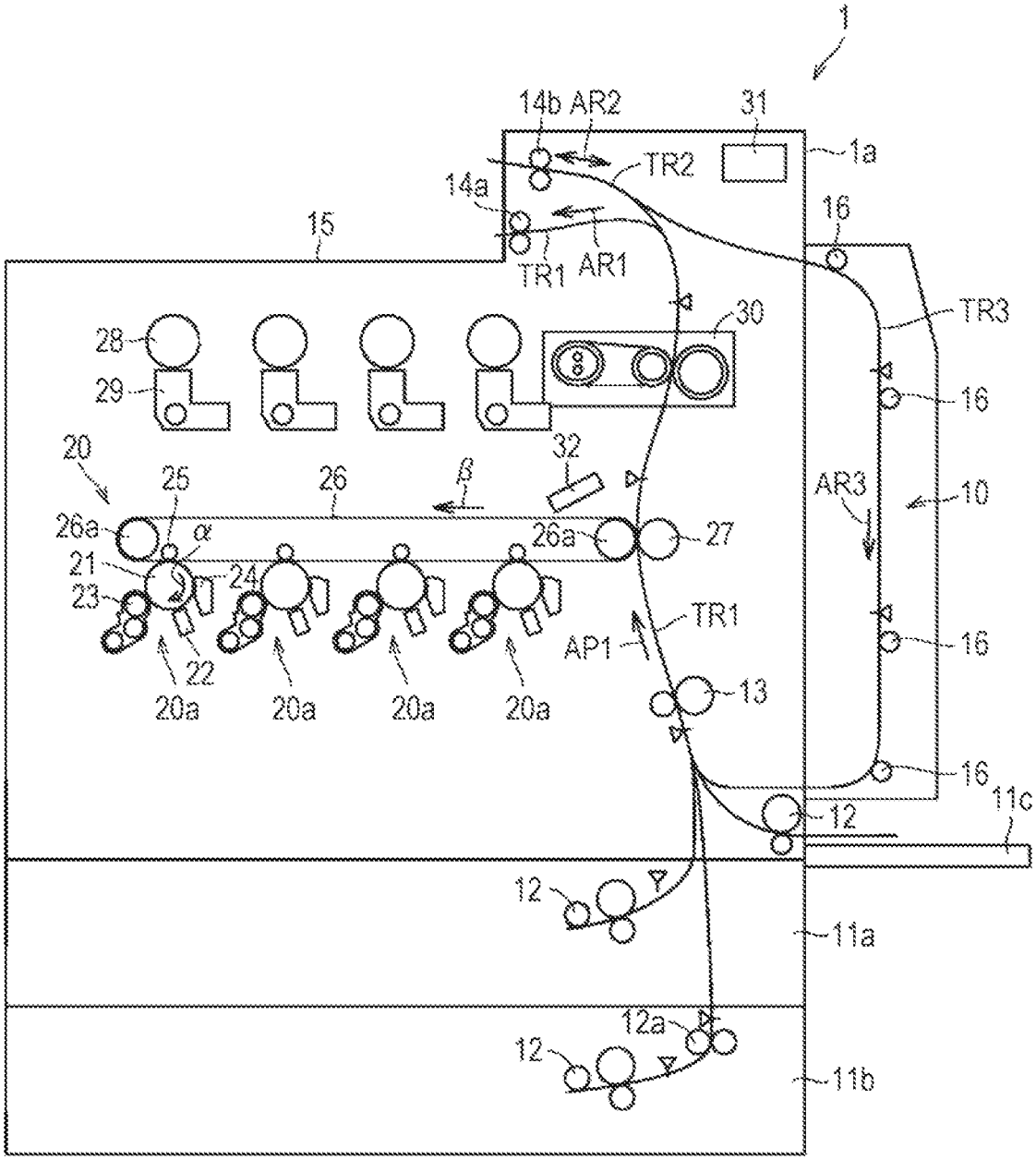
FIG. 1 is a sectional view of the configuration of an image forming apparatus according to an embodiment of the present invention.

FIG. 1 is a sectional view of the configuration of the image forming apparatus 1 according to the embodiment of the present invention.

With reference to FIG. 1, the image forming apparatus 1 according to the present embodiment together with a mobile terminal 2 (FIG. 3) is included in an image forming system. The image forming apparatus 1 mainly includes a sheet conveyer 10, an image former 20, a fixer 30, an operation panel 31 (exemplary receiver and display), and a microphone 32 (exemplary sound acquirer).

The sheet conveyer 10 conveys a sheet along conveyance paths TR1, TR2, and TR3. Arrows AR1, AR2, and AR3 indicate the conveyance direction of a sheet in the conveyance paths TR1, TR2, and TR3, respectively. The sheet conveyer 10 includes sheet feeding trays 11*a* and 11*b*, a manual feeding tray 11*c*, sheet feeding rollers 12, a vertical conveyance roller 12*a*, a registration roller 13, a sheet discharge roller 14*a*, a reverse roller 14*b*, a sheet discharge tray 15, and a plurality of conveyance rollers 16. The sheet feeding trays 11*a* and 11*b* each house sheets on which an image is to be formed. The manual feeding tray 11*c* is a part in which sheets for manual feeding are to be disposed. The sheet feeding rollers 12 are provided between the sheet feeding tray 11*a* and the conveyance path TR1, between the sheet feeding tray 11*b* and the conveyance path TR1, and between the manual feeding tray 11*c* and the conveyance path TR1. The vertical conveyance roller 12*a* is provided at the conveyance path TR1 in the sheet feeding tray 11*b*. The registration roller 13 is provided at a position on the upstream side with respect to a secondary transfer roller 27 in the conveyance path TR1. The sheet discharge roller 14*a* is provided at the most downstream portion of the conveyance path TR1. The reverse roller 14*b* is provided at the most downstream portion of the conveyance path TR2. The sheet discharge tray 15 is provided at the upper portion of an image forming apparatus body 1*a*. The plurality of conveyance rollers 16 is provided along the conveyance path TR3.

The image former 20 combines images in four colors of yellow (Y), magenta (M), cyan (C), and black (K) in a so-called tandem system, to form a toner image on a sheet being conveyed. The image former 20 includes image forming units 20*a* for the colors of Y, M, C, and K, primary transfer rollers 25 for the colors of Y, M, C, and K, an intermediate transfer belt 26, a secondary transfer roller 27, and toner containers 28 and sub-hoppers 29 for the colors of Y, M, C, and K.

The image forming units 20*a* for the colors of Y, M, C, and K each generate a toner image onto the intermediate transfer belt 26 in a well-known electrophotographic system and the tandem system. The image forming units 20*a* for the colors of Y, M, C, and K each include, for example, a photoconductor 21, an exposer 22, a developer 23, and a cleaner 24. Each photoconductor 21 is driven so as to rotate in the direction indicated with an arrow α in FIG. 1. The photoconductors 21 are each provided with the exposer 22, the developer 23, and the cleaner 24 therearound.

The intermediate transfer belt 26 is provided at the upper portions of the image forming units 20*a* for the colors of Y, M, C, and K. The intermediate transfer belt 26 that is annular is stretched over rotary rollers 26*a*. The intermediate transfer belt 26 is driven so as to rotate in the direction indicated with an arrow β in FIG. 1. The primary transfer rollers 25 are opposed to the respective photoconductors 21 with the intermediate transfer belt 26 sandwiched therebetween. The secondary transfer roller 27 is in contact with the intermediate transfer belt 26 in the conveyance path TR1.

The toner containers 28 are provided above the intermediate transfer belt 26. The toner containers 28 are detachably attached to the image forming apparatus body 1*a* through a door (not illustrated) provided, for example, at the front face of the image forming apparatus body 1*a*. The toner containers 28 each house toner. The sub-hoppers 29 each connect the toner container 28 and the developer 23. The sub-hoppers 29 each convey the toner from the toner container 28 to the developer 23.

The fixer 30 conveys a sheet bearing the toner image along the conveyance path TR1 while grasping the sheet, to fix the toner image on the sheet.

The operation panel 31 is provided at the front face of the upper portion of the image forming apparatus body 1*a*. The operation panel 31 displays various types of information and receives various operations.

The microphone 32 provided at an arbitrary location in the image forming apparatus body 1*a*, acquires the sound of operation of a movable member in the image forming apparatus 1. One microphone 32 may be provided or a plurality of microphones 32 may be provided at mutually different locations in the image forming apparatus body 1*a*.

The image forming apparatus 1 rotates each photoconductor 21, and exposes the surface of each photoconductor 21 charged by a charger (not illustrated), with the exposer 22 in accordance with image forming information. This arrangement allows formation of an electrostatic latent image on the surface of each photoconductor 21.

Next, the image forming apparatus 1 performs, to each photoconductor 21 on which the electrostatic latent image is formed, a supply of the toner from the developer 23 and development, to form a toner image on the surface of each photoconductor 21.

Next, the image forming apparatus 1 sequentially transfers the respective toner images formed on the photoconductors 21, to the surface of the intermediate transfer belt 26, with the primary transfer rollers 25 (primary transfer). For a full-color image, a toner image in which toner images for the colors of Y, M, C, and K are combined, is formed on the surface of the intermediate transfer belt 26.

The image forming apparatus 1 removes toner that has not been transferred to the intermediate transfer belt 26, remaining on each photoconductor 21, with the cleaner 24.

Subsequently, the image forming apparatus 1 conveys the toner image formed on the surface of the intermediate transfer belt 26, to the position opposed to the secondary transfer roller 27, with the rotary rollers 26*a*.

Meanwhile, the image forming apparatus 1 feeds a sheet disposed in the sheet feeding tray 11*a*, the sheet feeding tray 11*b*, or the manual feeding tray 11*c*, by rotation of the sheet feeding roller 12, and conveys the sheet along the conveyance path TR1, as necessary with the vertical conveyance roller 12*a*. The image forming apparatus 1 leads the sheet to between the intermediate transfer belt 26 and the secondary transfer roller 27 by the registration roller 13 at a predetermined timing, and transfers the toner image formed on the surface of the intermediate transfer belt 26, to the sheet by the secondary transfer roller 27. The image forming apparatus 1 leads the sheet to which the toner image is transferred, to the fixer 30, and fixes the toner image to the sheet by the fixer 30.

For single-sided printing or after printing a second-time image on the sheet in double-sided printing, the image forming apparatus 1 discharges the sheet to which the toner image is fixed, to the sheet discharge tray 15 with the sheet discharge roller 14*a*.

After printing a first-time image on the sheet in double-sided printing, the image forming apparatus 1 conveys the sheet to which the toner image is fixed, to the reverse roller 14*b*, and leads the sheet into the conveyance path TR3 by a switchback of the sheet with the reverse roller 14*b*. The sheet led into the conveyance path TR3 is conveyed by the plurality of conveyance rollers 16. Then, the sheet turned upside down is again led into the position on the upstream side with respect to the secondary transfer roller 27 in the conveyance path TR1. After that, the image forming apparatus 1 prints a second-time image in double-sided printing, on the sheet.

When the toner in any of the developers 23 is less in amount due to image forming, the image forming apparatus 1 replenishes toner from the toner container 28 for the color corresponding to the developer 23, to the developer 23 through the sub-hopper 29.

Figure 2:
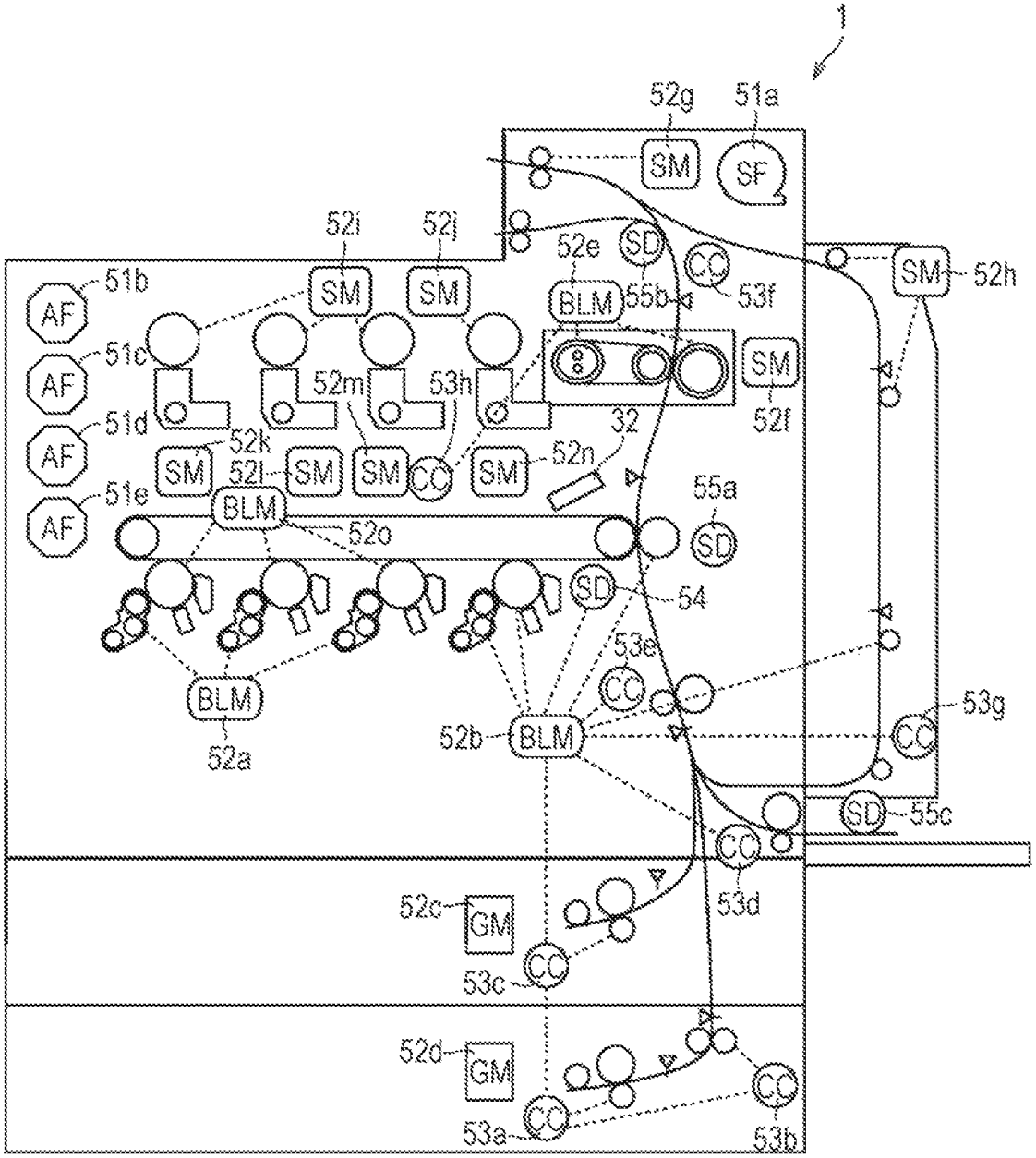
FIG. 2 is a schematic sectional view of movable members included in the image forming apparatus in the embodiment of the present invention.

FIG. 2 is a schematic sectional view of movable members included in the image forming apparatus 1 in the embodiment of the present invention.

With reference to FIGS. 1 and 2, the image forming apparatus 1 includes, as the movable members, fans 51*a*, 51*b*, 51*c*, 51*d*, and 51*e* (hereinafter, also collectively referred to as fans 51) (exemplary first and second rotors and first and second movable members), motors 52*a*, 52*b*, 52*c*, 52*d*, 52*e*, 52*f*, 52*g*, 52*h*, 52*i*, 52*j*, 52*k*, 52*l*, 52*m*, 52*n*, and 52*o* (hereinafter, also collectively referred to as motors 52) (exemplary first and second rotors and first and second movable members), clutches 53*a*, 53*b*, 53*c*, 53*d*, 53*e*, 53*f*, 53*g*, and 53*h* (hereinafter, also collectively referred to as clutches 53) (exemplary transferer and first and second movable members), a solenoid 54 (exemplary transferer and first and second movable members), and solenoids 55*a*, 55*b*, and 55*c*.

The fan 51*a* is a sirocco fan that cools a sheet being conveyed. The fan 51*b* is an axial fan that cools the toner containers 28. The fan 51*c* is an axial fan that cools the inside on the rear face side of image forming apparatus body 1*a*. The fan 51*d* is an axial fan that cools, for example, the cleaners 24 (transfer cleaners). The fan 51*e* is an axial fan (power-source fan) that cools a power source (not illustrated) and the exposers 22.

The motor 52*a* is a brushless motor that drives developers 23. The motor 52*b* is a brushless motor that drives the sheet feeding rollers 12, the vertical conveyance roller 12*a*, a conveyance roller 16, the photoconductor 21 for K, the developer 23 for K, and the secondary transfer roller 27, rotatably. The motors 52*c* and 52*d* are direct current (DC) geared motors that lift up sheets housed in the sheet feeding trays 11*a* and 11*b*, respectively. The motor 52*e* is a brushless motor that drives a heating roller and a pressing roller in the fixer 30 rotatably and performs pressing and releasing of the primary transfer rollers. The motor 52*f* is a stepping motor that performs pressing and releasing of the pressing roller in the fixer 30. The motor 52*g* is a stepping motor that drives the reverse roller 14*b*, rotatably. The motor 52*h* is a stepping motor that drives other conveyance rollers 16, rotatably. The motor 52*i* is a stepping motor that drives the toner containers 28 for Y, M, and C, rotatably. The motor 52*j* is a stepping motor that drives the toner container 28 for K, rotatably. The motors 52*k*, 52*l*, 52*m*, and 52*n* are stepping motors that drive respective internal screws of the sub-hoppers 29 for Y, M, C, and K, rotatably. The motor 52*o* is a brushless motor that drives the photoconductors 21 for Y, M, and C, rotatably.

The clutch 53*a* intermittently transfers rotation of the motor 52*b* to the sheet feeding roller 12 of the sheet feeding tray 11*b*. The clutch 53*b* intermittently transfers rotation of the motor 52*b* to the vertical conveyance roller 12*a*. The clutch 53*c* intermittently transfers rotation of the motor 52*b* to the sheet feeding roller 12 of the sheet feeding tray 11*a*. The clutch 53*d* intermittently transfers rotation of the motor 52*b* to the sheet feeding roller 12 of the manual feeding tray 11*c*. The clutch 53*e* intermittently transfers rotation of the motor 52*b* to the registration roller 13. The clutch 53*f* intermittently transfers rotation of the motor 52*b* to the sheet discharge roller 14*a*. The clutch 53*g* intermittently transfers rotation of the motor 52*b* to a conveyance roller 16. The clutch 53*h* intermittently transfers rotation of the motor 52*e* to the primary transfer rollers 25.

The solenoid 54 intermittently transfers rotation of the motor 52*b* to the developer 23 for K by magnetic force. The solenoid 55*a* opens and closes the shutter of an image density control (IDC) sensor (not illustrated) that detects the density of the toner image formed on the intermediate transfer belt 26, by magnetic force. The solenoid 55*b* switches a path in which a sheet is to be conveyed, between the conveyance paths TR1 and TR2, by magnetic force. The solenoid 55*c* lifts up a sheet disposed in the manual feeding tray 11*c*, by magnetic force.

Figure 3:
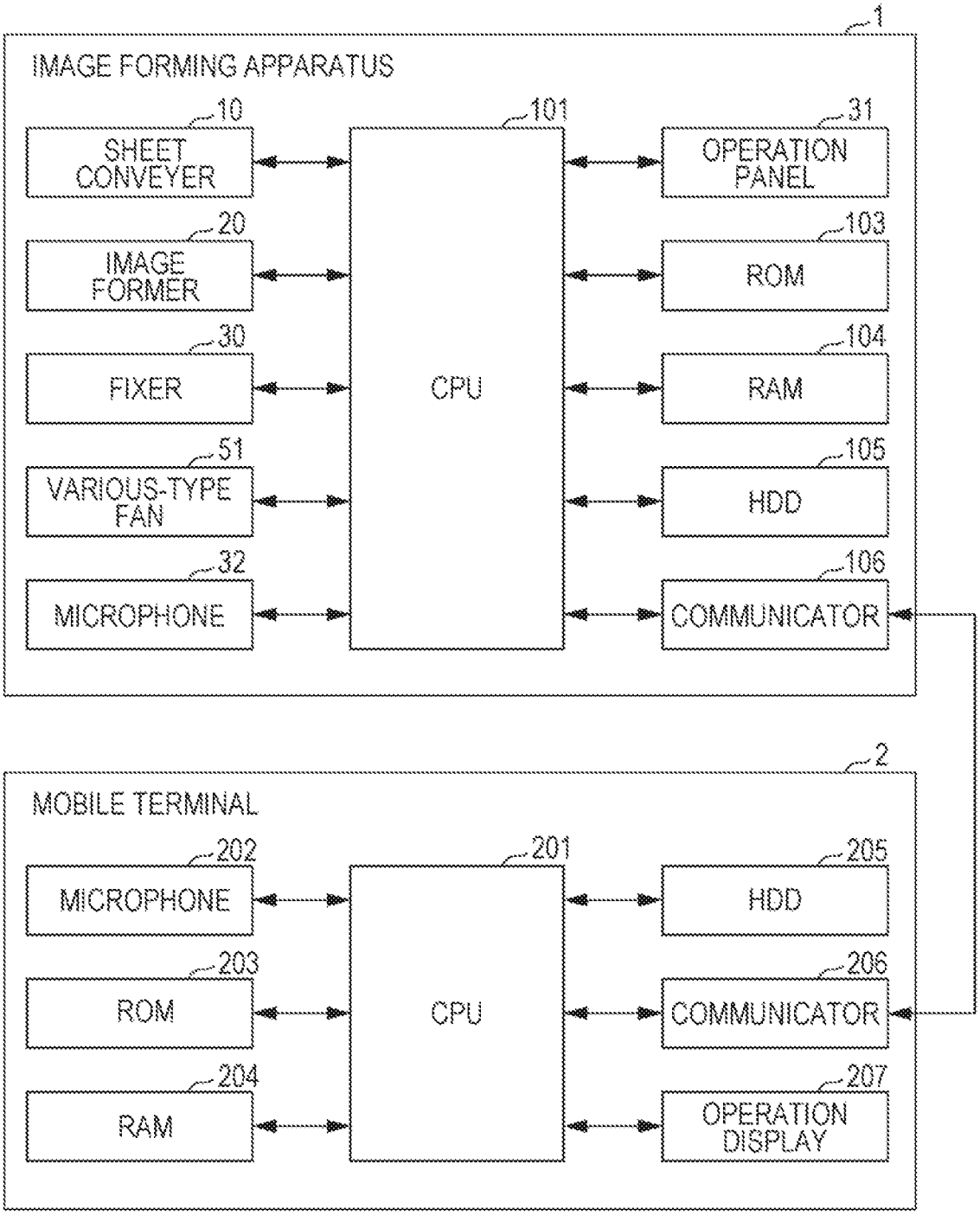
FIG. 3 is a block diagram of the control configuration of an image forming system according to the embodiment of the present invention.

FIG. 3 is a block diagram of the control configuration of the image forming system according to the embodiment of the present invention. Note that FIG. 3 illustrates a various-type fan 51 as the fans 51*a*, 51*b*, 51*c*, 51*d*, and 51*e*.

With reference to FIG. 3, the image forming apparatus 1 includes a central processing unit (CPU) 101 (exemplary driver and diagnoser), a read only memory (ROM) 103 (exemplary storage), a random access memory (RAM) 104, a hard disk drive (HDD) 105 (exemplary storage), and a communicator 106. The CPU 101 controls the operation of the entire image forming apparatus 1 in accordance with a control program. The ROM 103 stores the control program to be executed by the CPU 101. The RAM 104 that is a work area for the CPU 101, stores various types of information, temporarily. The HDD 105 stores various types of information. The communicator 106 performs wireless communication with the mobile terminal 2.

The mobile terminal 2 includes a CPU 201, a microphone 202, a ROM 203, a RAM 204, a HDD 205, a communicator 206, and an operation display 207. The CPU 201 controls the operation of the entire mobile terminal 2 in accordance with a control program. The microphone 202 acquires the sound of operation of a movable member in the image forming apparatus 1. The ROM 203 stores the control program to be executed by the CPU 201. The RAM 204 that is a work area for the CPU 201, stores various types of information, temporarily. The HDD 205 stores various types of information. The communicator 206 performs wireless communication with the image forming apparatus 1. The operation display 207 displays various types of information and receives various operations.

Operation of Abnormality Diagnosis to be Performed by Image Forming Apparatus Subsequently, an operation of abnormality diagnosis to be performed by the image forming apparatus 1 according to the present embodiment, will be described.

The CPU 101 causes the operation mode of the image forming apparatus 1 to transition from a normal mode to an abnormality diagnosis mode and displays a screen SR1 on the operation panel 31, after receiving a predetermined operation through the operation panel 31. The abnormality diagnosis mode is a mode in which abnormality diagnosis is to be performed on first and second movable members. The normal mode that is a mode in which no abnormality diagnosis is to be performed on each of the first and second movable members, is a mode in which printing is to be performed, for example.

Figures 4, 5:
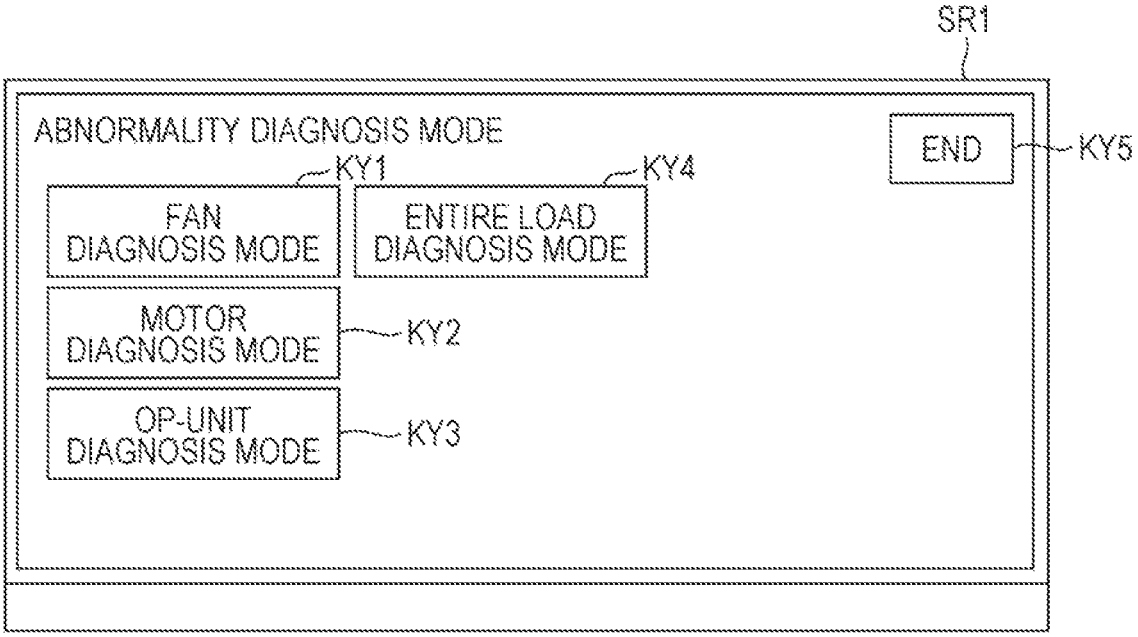
FIG. 4 is a schematic view of a screen to be displayed on an operation panel after a transition to an abnormality diagnosis mode, in the embodiment of the present invention.
FIG. 5 is a table of the order of movable members in which a CPU performs abnormality diagnosis in a fan diagnosis mode, in the embodiment of the present invention.

FIG. 4 is a schematic view of the screen SR1 to be displayed on the operation panel 31 after a transition to the abnormality diagnosis mode, in the embodiment of the present invention.

With reference to FIG. 4, the screen SR1 after the transition to the abnormality diagnosis mode includes keys KY1, KY2, KY3, KY4, and KY5 that are software keys. The key KY1 is a key to be depressed for performing abnormality diagnosis on the fans 51 in the image forming apparatus 1. The key KY2 is a key to be depressed for performing abnormality diagnosis on the motors 52 in the image forming apparatus 1. The key KY3 is a key to be depressed for performing abnormality diagnosis on movable members in an option unit (e.g., image reader or post-processor) in a case where the image forming apparatus 1 is equipped with the option unit (here, because the image forming apparatus 1 is equipped with no option unit, the description for the operation of the image forming apparatus 1 in a case where the key KY3 is depressed, will be omitted). The key KY4 is a key to be depressed for performing abnormality diagnosis on all movable members (load) in the image forming apparatus 1. The key KY5 is a key to be depressed for returning the operation mode of the image forming apparatus 1 to the normal mode.

After any key of the keys KY1, KY2, KY3, and KY4 is depressed, the CPU 101 starts abnormality diagnosis on the movable members corresponding to the depressed key.

The CPU 101 extracts two movable members (first and second movable members) that have not been diagnosed, from a plurality of movable members on which abnormality diagnosis is to be performed, and drives simultaneously two rotors (first and second rotors) corresponding to the extracted movable members, at mutually different numbers of revolutions or speeds. The number of revolutions or the speed for abnormality diagnosis of at least one rotor of the two rotors, is preferably set differently from the number of revolutions or the speed in the normal mode of the at least one rotor. The CPU 101 acquires the sounds of operation of the two movable members with the microphone 32 while driving the two rotors. The CPU 101 performs abnormality diagnosis on the two movable members, on the basis of the acquired sounds of operation.

Note that, in a case where a predetermined condition is satisfied in the normal mode (for example, during performance or after performance of image stabilization processing that is periodically performed by the image forming apparatus 1 after printing for a predetermined number of sheets or after the elapse of a predetermined amount of time), the CPU 101 may transition to the abnormality diagnosis mode, to automatically start abnormality diagnosis on necessary movable members in the image forming apparatus 1 (without reception of an input through the screen SR1).

(1) Fan Diagnosis Mode

FIG. 5 is a table of the order of movable members in which the CPU 101 performs abnormality diagnosis in a fan diagnosis mode, in the embodiment of the present invention.

With reference to FIGS. 2 and 5, after the key KY1 is depressed on the screen SR1 of FIG. 4, the CPU 101 transitions to the fan diagnosis mode in the abnormality diagnosis mode, to perform abnormality diagnosis on the fans 51.

The fans 51 each include a rotor that is a rotatable member. Because each fan 51 itself includes the rotor, in a case where abnormality diagnosis is performed on the fans 51, the fans 51 on which the abnormality diagnosis is being performed, are each driven as a rotor.

After transitioning to the fan diagnosis mode, the CPU 101 extracts the fans 51*a* and 51*b* to perform first-time abnormality diagnosis. Specifically, the CPU 101 drives simultaneously the fans 51*a* and 51*b* at mutually different numbers of revolutions. The CPU 101 acquires the sounds of operation of the fans 51*a* and 51*b* with the microphone 32 while driving the fans 51*a* and 51*b*. The CPU 101 performs abnormality diagnosis on the fans 51*a* and 51*b*, on the basis of the acquired sounds of operation.

When finishing the first-time abnormality diagnosis, the CPU 101 extracts the fans 51*c* and 51*d* to perform second-time abnormality diagnosis in a manner similar to that for the first time. When finishing the second-time abnormality diagnosis, the CPU 101 extracts the fan 51*e* and drives only the fan 51*e* to perform third-time abnormality diagnosis on the fan 51*e*. The diagnosis on the fans 51 is completed by the above process.

Figure 6:
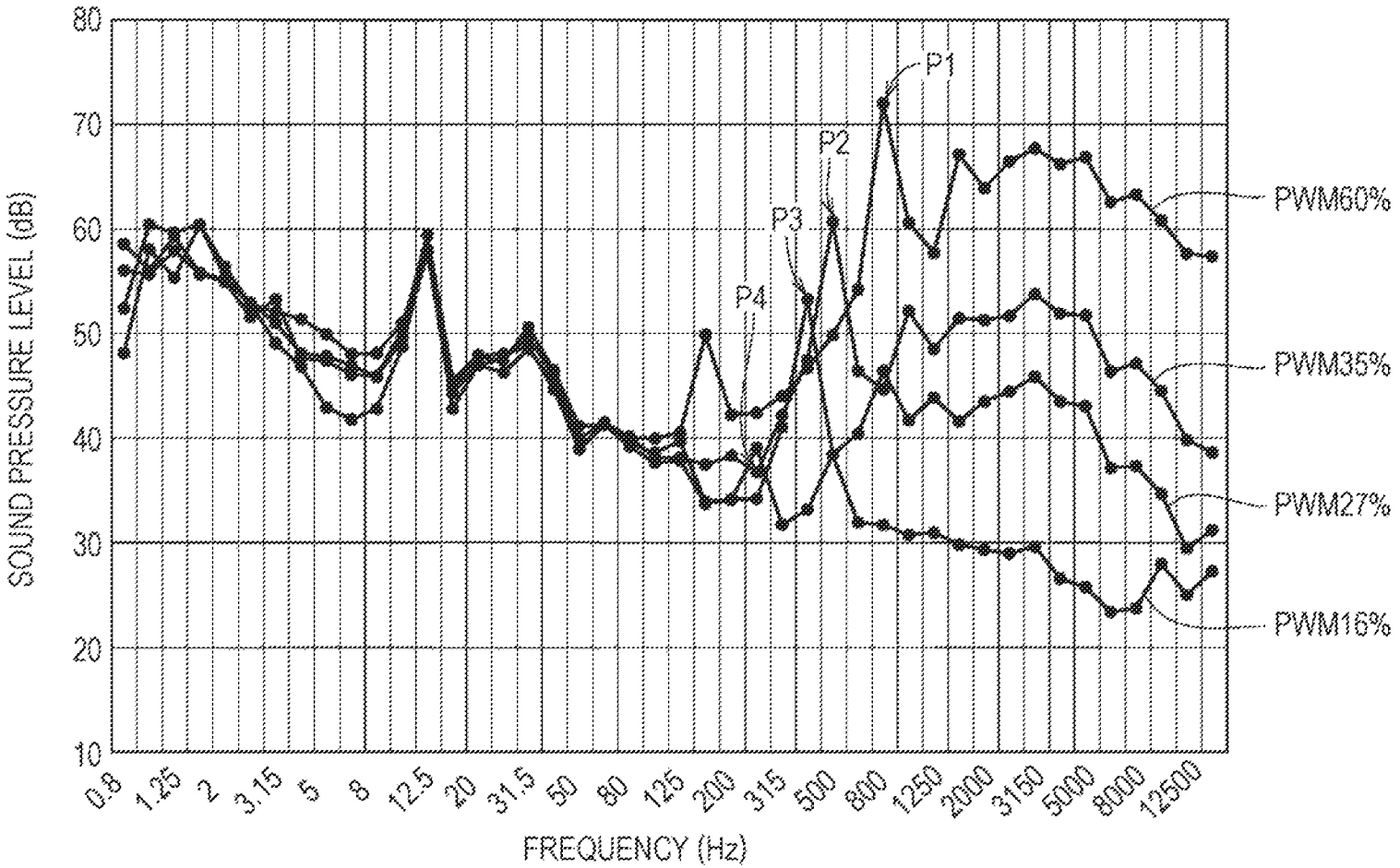
FIG. 6 is a schematic graph of the frequency characteristics of the sound of operation of a normal fan at a plurality of mutually different numbers of revolutions.

FIG. 6 is a schematic graph of the frequency characteristics of the sound of operation of a normal fan 51 at a plurality of mutually different numbers of revolutions.

With reference to FIG. 6, input of a pulse width modulation (PWM) signal from the CPU 101 to a circuit of the fan 51 varies the duty of PWM, so that the number of revolutions of the fan 51 is controlled. The number of revolutions of the fan 51 may be controlled by a method of changing a power source voltage to be supplied to the fan 51 or inserting a resistor into a power-source supply line to the fan 51.

The sound of operation of the fan 51 is classified into the sound of revolutions and the sound of turbulence. From the sounds, the sound of revolutions has a peak in the sound pressure level of the sound of operation. The frequency of the peak in the sound pressure level of the sound of operation, is calculated by the product of the number of blades (rotor blades) and the number of revolutions per second. As an example, in a case where the number of blades of the fan 51 is five and the number of revolutions is 9870 rpm (number of revolutions in a case where the duty of PWM is set at 60%), the calculated frequency of the peak in the sound pressure level of the sound of operation is 823 Hz. The calculated result agrees with the frequency of a peak P1 in the frequency characteristic in a case where PWM is 60% in FIG. 6.

From FIG. 6, it can be understood that a variation in the number of revolutions of the fan 51 causes a shift to the lower frequency side in the frequency of the peak of the sound pressure level of the sound of operation. Specifically, at the number of revolutions of the fan 51 in a case where the duty of PWM is set at 60%, the frequency of the peak P1 is present in the neighborhood of 820 Hz. At the number of revolutions of the fan 51 in a case where the duty of PWM is set at 35%, the frequency of a peak P2 is present in the neighborhood of 600 Hz. At the number of revolutions of the fan 51 in a case where the duty of PWM is set at 27%, the frequency of a peak P3 is present in the neighborhood of 450 Hz. At the number of revolutions of the fan 51 in a case where the duty of PWM is set at 16%, the frequency of a peak P4 is present in the neighborhood of 300 Hz.

The ROM 103 stores peak information as the reference value. The peak information is information regarding, in a case where a rotor is driven at the number of revolutions to be used in abnormality diagnosis, the frequency and the sound pressure level of the peak in the frequency characteristic of the normal sound of operation of the movable member corresponding to the rotor. Here, the ROM 103 stores, as the peak information regarding the fan 51, information regarding the respective frequencies and sound pressure levels of the peaks P1, P2, P3, and P4 in the frequency characteristics of the sound of operation of the fan 51.

In abnormality diagnosis for one time, the CPU 101 compares the sounds of operation of two fans 51 acquired in the abnormality diagnosis with the peak information regarding the fans 51, to determine the presence or absence of an abnormality for each of the two fans 51 on which the abnormality diagnosis is being performed.

Specifically, the CPU 101 drives each of the two fans 51 on which the abnormality diagnosis is being performed, at duties of 60% and 27%, and collects the sounds of operation of the two fans 51 with the microphone 32. The CPU 101 determines that each fan 51 driven at a duty of 60% is normal, in a case where the sound pressure level at a frequency identical to that of the peak P1 in the acquired sound of operation agrees with the sound pressure level of the peak P1 (for example, in a case where the sound pressure level at the frequency identical to that of the peak P1 in the acquired sound of operation is in the range of 90% to 110% of the sound pressure level of the peak P1). Meanwhile, the CPU 101 determines that each fan 51 driven at a duty of 60% is abnormal, in a case where the sound pressure level at the frequency identical to that of the peak P1 in the acquired sound of operation disagrees with the sound pressure level of the peak P1 (for example, in a case where the sound pressure level at the frequency identical to that of the peak P1 in the acquired sound of operation is out of the range of 90% to 110% of the sound pressure level of the peak P1).

Particularly, in a case where the sound pressure level at the frequency identical to that of the peak P1 in the acquired sound of operation is higher than the sound pressure level of the peak P1, it is estimated that an abnormal sound occurs from each fan 51 driven at a duty of 60%. In a case where the sound pressure level at the frequency identical to that of the peak P1 in the acquired sound of operation is lower than the sound pressure level of the peak P1, it is estimated that each fan 51 driven at a duty of 60% does not revolve accidentally or that each fan 51 driven at a duty of 60% revolves abnormally.

Similarly, the CPU 101 determines that each fan 51 driven at a duty of 27% is normal, in a case where the sound pressure level at a frequency identical to that of the peak P3 in the acquired sound of operation agrees with the sound pressure level of the peak P3. The CPU 101 determines that each fan 51 driven at a duty of 27% is abnormal, in a case where the sound pressure level at the frequency identical to that of the peak P3 in the acquired sound of operation disagrees with the sound pressure level of the peak P3.

In a case where detecting an abnormality of a fan 51 on which the abnormality diagnosis is being performed, the CPU 101 displays the fan 51 from which the abnormality is detected, on the operation panel 31. This arrangement finishes the abnormality diagnosis for one time.

Because two fans 51 on which abnormality diagnosis is being performed are driven at mutually different numbers of revolutions, the sounds of operation in a case where the two fans 51 are normal, are different mutually. This arrangement enables the CPU 101 to distinguish the respective sounds of operation of the two fans 51 and to perform abnormality diagnosis on the two fans 51, simultaneously.

Figure 7:
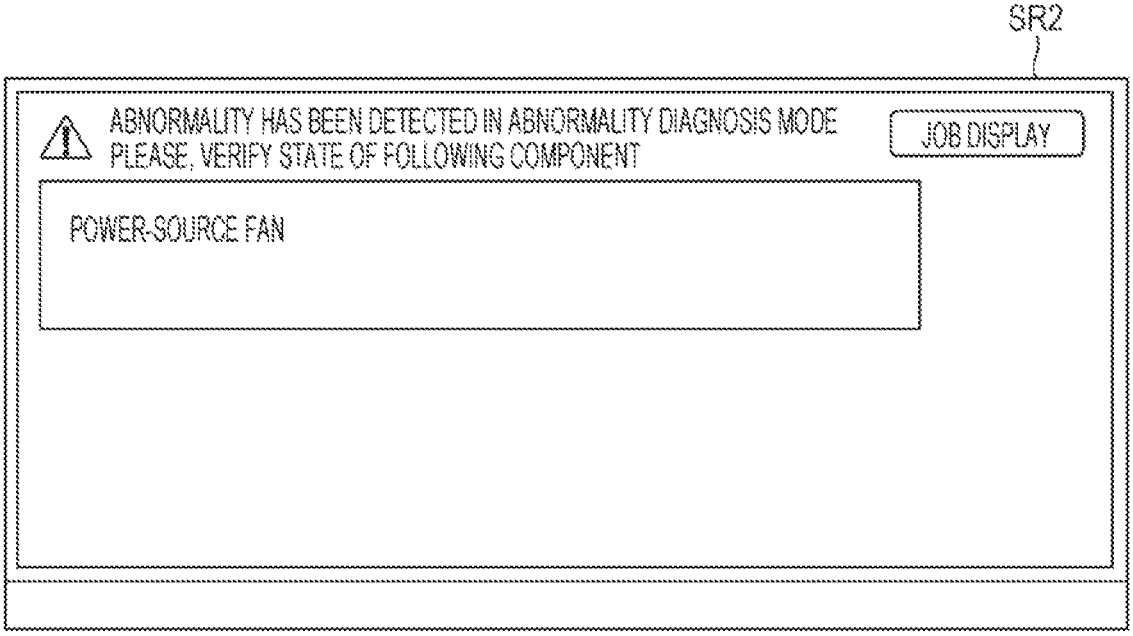
FIG. 7 is a schematic view of a screen to be displayed on the operation panel in a case where an abnormality of a fan is detected, in the embodiment of the present invention.

FIG. 7 is a schematic view of a screen SR2 to be displayed on the operation panel 31 in a case where an abnormality of a fan 51 is detected, in the embodiment of the present invention.

With reference to FIG. 7, after performing abnormality diagnosis, the CPU 101 displays a result of the abnormality diagnosis as the screen SR2, on the operation panel 31. The screen SR2 includes a message reporting abnormality detection, and a fan 51 from which an abnormality is detected. Here, as the fan 51 from which an abnormality is detected, "power-source fan" corresponding to the fan 51*e* is displayed.

Note that, in a case where detecting an abnormality of a fan 51, the CPU 101 may transmit information regarding the detected abnormality, to an external server or a mobile terminal possessed by a serviceman who maintains the image forming apparatus 1, through network communication with the communicator 106.

Figure 8:
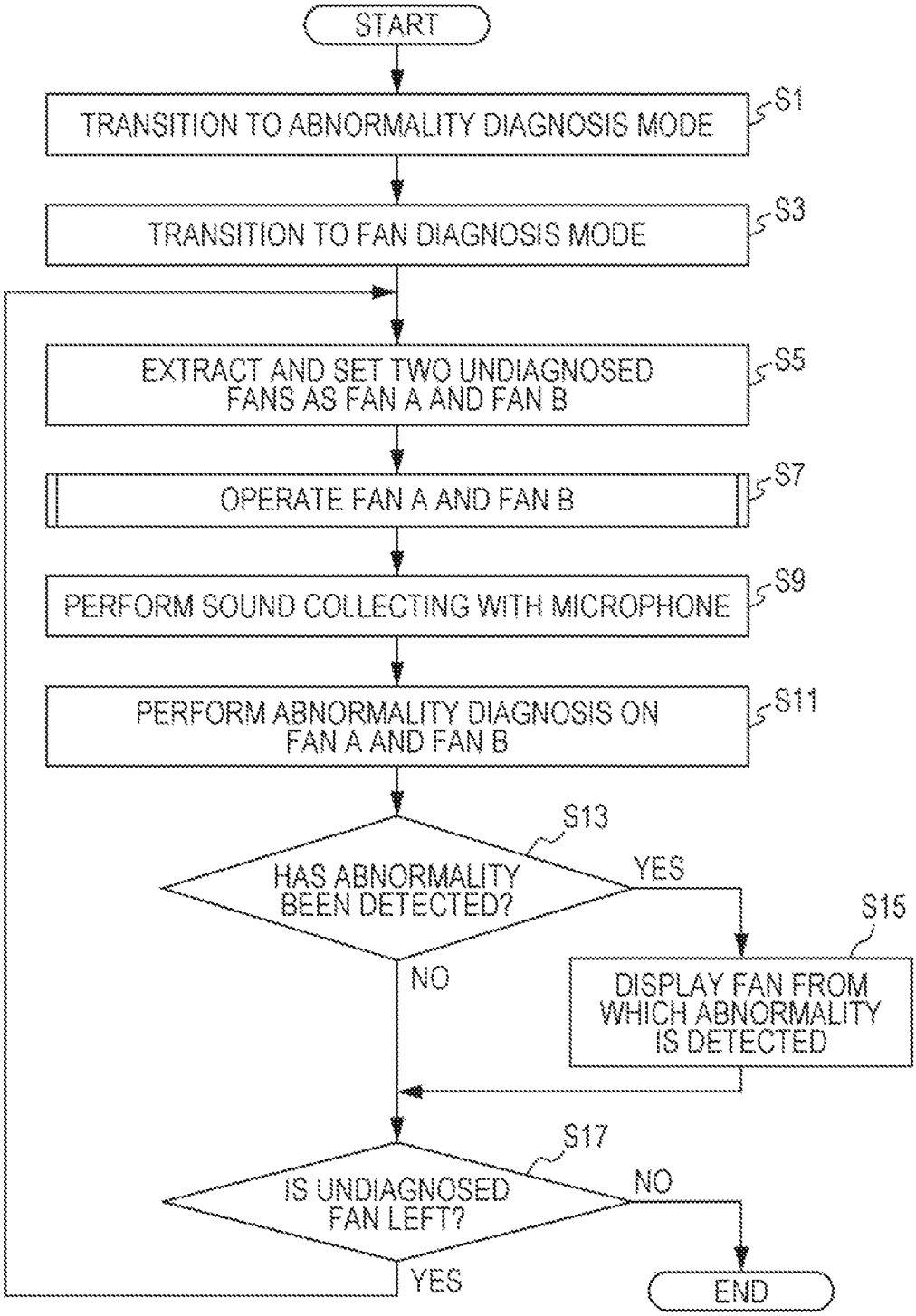
FIG. 8 is a flowchart of the operation of the image forming apparatus in the fan diagnosis mode according to the embodiment of the present invention.

FIG. 8 is a flowchart of the operation of the image forming apparatus 1 in the fan diagnosis mode according to the embodiment of the present invention.

With reference to FIG. 8, the CPU 101 causes the operation mode of the image forming apparatus 1 to transition from the normal mode to the abnormality diagnosis mode (S1), and further causes the operation mode of the image forming apparatus 1 to transition to the fan diagnosis mode in the abnormality diagnosis mode (S3). Then, the CPU 101 extracts two fans 51 that have not been diagnosed, from the fans 51 to be diagnosed, and sets the fans 51 as a fan A and a fan B (S5).

Next, the CPU 101 operates the fan A at the number of revolutions A and operates the fan B at the number of revolutions B different from the number of revolutions A (S7), and collects the sounds of operation of the fan A and the fan B with the microphone 32 (S9). Subsequently, the CPU 101 diagnoses the presence or absence of an abnormality for each of the fan A and the fan B, on the basis of the sounds of operation collected with the microphone 32 (S11). Next, the CPU 101 determines whether an abnormality has been detected for at least one of the fan A and the fan B (S13).

At step S13, in a case where determining that the abnormality has been detected for the at least one of the fan A and the fan B (YES at S13), the CPU 101 displays the fan 51 from which the abnormality is detected, on the operation panel 31 (S15), and proceeds to the processing at step S17.

At step S13, in a case where determining that no abnormality has been detected for the fan A and the fan B (NO at S13), the CPU 101 proceeds to the processing at step S17.

At step S17, the CPU 101 determines whether a fan 51 that has not been diagnosed, is left in the fans 51 to be diagnosed (S17).

At step S17, in a case where determining that the fan 51 that has not been diagnosed, is left (YES at S17), the CPU 101 proceeds to the processing at step S5.

At step S17, in a case where determining that no fan 51 that has not been diagnosed, is left (NO at S17), the CPU 101 finishes the processing.

(2) Motor Diagnosis Mode

FIG. 9 is a table of the order of movable members in which the CPU 101 performs abnormality diagnosis in a motor diagnosis mode according to the embodiment of the present invention.

With reference to FIGS. 2 and 9, after the key KY2 is depressed on the screen SR1 of FIG. 4, the CPU 101 transitions to the motor diagnosis mode in the abnormality diagnosis mode, to perform abnormality diagnosis on the motors 52.

The motors 52 each include a rotor that is a rotatable member. Because each motor 52 itself includes the rotor, in a case where abnormality diagnosis is performed on the motors 52, the motors 52 on which the abnormality diagnosis is being performed, are each driven as a rotor.

After transitioning to the motor diagnosis mode, the CPU 101 extracts the motors 52*a* and 52*b* to perform first-time abnormality diagnosis. Specifically, the CPU 101 drives simultaneously the motors 52*a* and 52*b* at mutually different numbers of revolutions. The CPU 101 acquires the sounds of operation of the motors 52*a* and 52*b* with the microphone 32 while driving the motors 52*a* and 52*b*. The CPU 101 performs abnormality diagnosis on the motors 52*a* and 52*b*, on the basis of the acquired sounds of operation.

When finishing the first-time abnormality diagnosis, the CPU 101 extracts the motors 52*c* and 52*d* to perform second-time abnormality diagnosis in a manner similar to that for the first time. When finishing the second-time abnormality diagnosis, the CPU 101 extracts the motors 52*e* and 52*f* to perform third-time abnormality diagnosis in a manner similar to that for the first time. When finishing the third-time abnormality diagnosis, the CPU 101 extracts the motors 52*g* and 52*h* to perform fourth-time abnormality diagnosis in a manner similar to that for the first time. When finishing the fourth-time abnormality diagnosis, the CPU 101 extracts the motors 52*i* and 52*j* to perform fifth-time abnormality diagnosis in a manner similar to that for the first time. When finishing the fifth-time abnormality diagnosis, the CPU 101 extracts the motors 52*k* and 52*l* to perform sixth-time abnormality diagnosis in a manner similar to that for the first time. When finishing the sixth-time abnormality diagnosis, the CPU 101 extracts the motors 52*m* and 52*n* to perform seventh-time abnormality diagnosis in a manner similar to that for the first time. When finishing the seventh-time abnormality diagnosis, the CPU 101 extracts the motor 52*o* and drives only the motor 52*o* to perform eighth-time abnormality diagnosis on the motor 52*o*. The diagnosis on the motors 52 is completed by the above process.

The ROM 103 stores the peak information regarding the motors 52.

In abnormality diagnosis for one time, the CPU 101 compares the sounds of operation of two motors 52 acquired in the abnormality diagnosis with the peak information regarding the motors 52, to determine the presence or absence of an abnormality for each of the two motors 52 on which the abnormality diagnosis is being performed. The details of the method of performing abnormality diagnosis on the motors 52 is similar to that of the method of performing abnormality diagnosis on the fans 51, and thus the descriptions thereof will be omitted.

In a case where detecting an abnormality of a motor 52 on which the abnormality diagnosis is being performed, the CPU 101 displays the motor 52 from which the abnormality is detected, on the operation panel 31. This arrangement finishes the abnormality diagnosis for one time.

Figure 10:
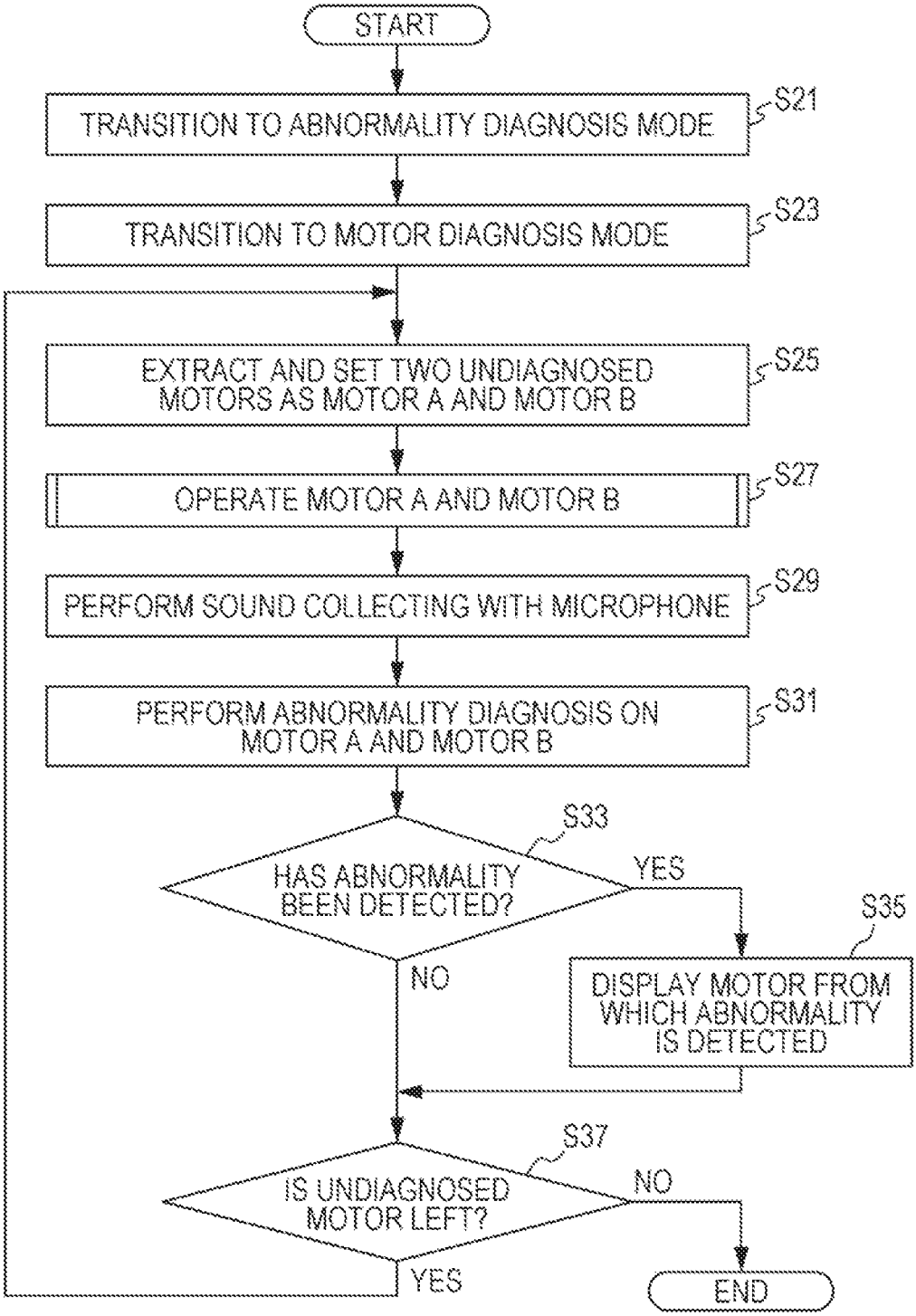
FIG. 10 is a flowchart of the operation of the image forming apparatus in the motor diagnosis mode according to the embodiment of the present invention.

FIG. 10 is a flowchart of the operation of the image forming apparatus 1 in the motor diagnosis mode according to the embodiment of the present invention.

With reference to FIG. 10, the CPU 101 causes the operation mode of the image forming apparatus 1 to transition from the normal mode to the abnormality diagnosis mode (S21), and further causes the operation mode of the image forming apparatus 1 to transition to the motor diagnosis mode in the abnormality diagnosis mode (S23). Then, the CPU 101 extracts two motors 52 that have not been diagnosed, from the motors 52 to be diagnosed, and sets the motors 52 as a motor A and a motor B (S25).

Next, the CPU 101 operates the motor A at the number of revolutions A and operates the motor B at the number of revolutions B different from the number of revolutions A (S27), and collects the sounds of operation of the motor A and the motor B with the microphone 32 (S29). Subsequently, the CPU 101 diagnoses the presence or absence of an abnormality for each of the motor A and the motor B, on the basis of the sounds of operation collected with the microphone 32 (S31). Next, the CPU 101 determines whether an abnormality has been detected for at least one of the motor A and the motor B (S33).

At step S33, in a case where determining that the abnormality has been detected for the at least one of the motor A and the motor B (YES at S33), the CPU 101 displays the motor 52 from which the abnormality is detected, on the operation panel 31 (S35), and proceeds to the processing at step S37.

At step S33, in a case where determining that no abnormality has been detected for the motor A and the motor B (NO at S33), the CPU 101 proceeds to the processing at step S37.

At step S37, the CPU 101 determines whether a motor 52 that has not been diagnosed, is left in the motors 52 to be diagnosed (S37).

At step S37, in a case where determining that the motor 52 that has not been diagnosed, is left (YES at S37), the CPU 101 proceeds to the processing at step S25.

At step S37, in a case where determining that no motor 52 that has not been diagnosed, is left (NO at S37), the CPU 101 finishes the processing.

(3) Entire Load Diagnosis Mode

FIG. 11 is a table of the order of movable members in which the CPU 101 performs abnormality diagnosis in an entire load diagnosis mode according to the embodiment of the present invention.

With reference to FIGS. 2 and 11, after the key KY4 is depressed on the screen SR1 of FIG. 4, the CPU 101 transitions to the entire load diagnosis mode in the abnormality diagnosis mode, to perform abnormality diagnosis on all movable members included in the image forming apparatus 1.

From the movable members included in the image forming apparatus 1, the clutches 53*a*, 53*b*, 53*c*, 53*d*, 53*e*, 53*f*, and 53*g* and the solenoid 54 each include a transferer that transfers power of the motor 52*b* to the other members. The clutch 53*h* includes a transferer that transfers power of the motor 52*e* to the other members. Thus, in a case where abnormality diagnosis is performed on each of the clutches 53*a*, 53*b*, 53*c*, 53*d*, 53*e*, 53*f*, and 53*g* and the solenoid 54, the motor 52*b* is driven as a rotor. In a case where abnormality diagnosis is performed on the clutch 53*h*, the motor 52*e* is driven as a rotor.

Note that, from the movable members included in the image forming apparatus 1, the solenoids 55*a*, 55*b*, and 55*c* do not each transfer power of a rotor, and thus are not applicable to the rotor and the transferer above. For the method of performing abnormality diagnosis on each of the solenoids 55*a*, 55*b*, and 55*c*, the description thereof will be omitted.

After transitioning to the entire load diagnosis mode, the CPU 101 extracts the motor 52*a* and the motor 52*b* to perform first-time abnormality diagnosis with the method described in (2) above. When finishing the first-time abnormality diagnosis, the CPU 101 extracts the motor 52*c* and the clutch 53*a* to perform second-time abnormality diagnosis. Specifically, the CPU 101 drives simultaneously the motor 52*c* and the motor 52*b* at mutually different numbers of revolutions. The motor 52*b* is the source of power to be transferred by the clutch 53*a*. The CPU 101 acquires the sound of operation of the motor 52*c* and the sound of operation of the clutch 53*a* (sound when the clutch 53*a* transfers the power of the motor 52*b* to the sheet feeding roller 12 of the sheet feeding tray 11*b*) with the microphone 32 while driving the motors 52*c* and 52*b*. The CPU 101 performs abnormality diagnosis on the motor 52*c* and the clutch 53*a*, on the basis of the acquired sounds of operation.

When finishing the second-time abnormality diagnosis, the CPU 101 extracts the motor 52*d* and the clutch 53*b* to perform third-time abnormality diagnosis in a manner similar to that for the second time. When finishing the third-time abnormality diagnosis, the CPU 101 extracts the motor 52*e* and the clutch 53*c* to perform fourth-time abnormality diagnosis in a manner similar to that for the second time.

When finishing the fourth-time abnormality diagnosis, the CPU 101 extracts the clutch 53*h* and the clutch 53*d* to perform fifth-time abnormality diagnosis. Specifically, the CPU 101 drives simultaneously the motor 52*e* and the motor 52*b* at mutually different numbers of revolutions. The motor 52*e* is the source of power to be transferred by the clutch 53*h*. The motor 52*b* is the source of power to be transferred by the clutch 53*d*. The CPU 101 acquires the sound of operation of the clutch 53*h* (sound when the clutch 53*h* transfers the power of the motor 52*e* to the primary transfer rollers 25) and the sound of operation of the clutch 53*d* (sound when the clutch 53*d* transfers the power of the motor 52*b* to the sheet feeding roller 12 of the manual feeding tray 11*c*) with the microphone 32 while driving the motors 52*e* and 52*b*. The CPU 101 performs abnormality diagnosis on the clutch 53*h* and the clutch 53*d*, on the basis of the acquired sounds of operation.

When finishing the fifth-time abnormality diagnosis, the CPU 101 extracts the motor 52*f* and the clutch 53*e* to perform sixth-time abnormality diagnosis in a manner similar to that for the second time. When finishing the sixth-time abnormality diagnosis, the CPU 101 extracts the motor 52*g* and the clutch 53*f* to perform seventh-time abnormality diagnosis in a manner similar to that for the second time. When finishing the seventh-time abnormality diagnosis, the CPU 101 extracts the motor 52*h* and the clutch 53*g* to perform eighth-time abnormality diagnosis in a manner similar to that for the second time.

When finishing the eighth-time abnormality diagnosis, the CPU 101 extracts the motor 52*i* and the solenoid 54 to perform ninth-time abnormality diagnosis. Specifically, the CPU 101 drives simultaneously the motor 52*i* and the motor 52*b* at mutually different numbers of revolutions. The motor 52*b* is the source of power to be transferred by the solenoid 54. The CPU 101 acquires the sound of operation of the motor 52*i* and the sound of operation of the solenoid 54 (sound when the solenoid 54 transfers the power of the motor 52*b* to the developer 23 for K) with the microphone 32 while driving the motors 52*i* and 52*b*. The CPU 101 performs abnormality diagnosis on the motor 52*i* and the solenoid 54, on the basis of the acquired sounds of operation.

When finishing the ninth-time abnormality diagnosis, the CPU 101 performs abnormality diagnosis on the motors 52*j*, 52*k*, 52*l*, 52*m*, 52*n*, and 52*o* and the fans 51*a*, 51*b*, 51*c*, 52*d*, and 52*e* that are the remaining movable members, with the method described in the item (1) or (2) above. The CPU 101 performs abnormality diagnosis on the solenoids 55*a*, 55*b*, and 55*c*. The abnormality diagnosis on all the movable members in the image forming apparatus 1, is completed by the above process.

The ROM 103 stores the peak information regarding each of the clutches 53 and the solenoid 54, to be used in abnormality diagnosis.

In a case where performing abnormality diagnosis on a set of a motor 52 and a clutch 53, the CPU 101 compares the sounds of operation of the motor 52 and the clutch 53 acquired in the abnormality diagnosis with the peak information regarding the motor 52 and the clutch 53, to determine the presence or absence of an abnormality for each of the motor 52 and the clutch 53 on which the abnormality diagnosis is being performed. The details of the method of performing abnormality diagnosis on the clutches 53 is similar to that of the method of performing abnormality diagnosis on the fans 51, and thus the descriptions thereof will be omitted.

In a case where detecting an abnormality of the motor 52 or the clutch 53 on which the abnormality diagnosis is being performed, the CPU 101 displays the motor 52 or the clutch 53 from which the abnormality is detected, on the operation panel 31. This arrangement finishes the abnormality diagnosis on a set of the motor 52 and the clutch 53.

Note that abnormality diagnosis on a set of a motor 52 and the solenoid 54 is performed with a method similar to the method of performing abnormality diagnosis on a set of a motor 52 and a clutch 53 described above, and thus the description thereof will be omitted.

MODIFICATIONS

First Modification

With reference to FIG. 1, in a case where one microphone 32 is disposed in the image forming apparatus body 1*a*, in order to avoid far distance from the movable members to be diagnosed, the microphone 32 is preferably disposed at substantially the center in the image forming apparatus body 1*a*. However, even when the microphone 32 is disposed at substantially the center of the image forming apparatus body 1*a*, the distances of two movable members on which abnormality diagnosis is to be performed simultaneously, from the microphone 32 are not identical and the sound pressure levels of the sounds of operation of the two movable members on which abnormality diagnosis is to be performed simultaneously, are not identical. For the sounds of operation of the two movable members collected with the microphone 32, there is a possibility that the sound pressure level of the sound of operation of one movable member is higher than the sound pressure level of the sound of operation of the other movable member.

Figure 12:
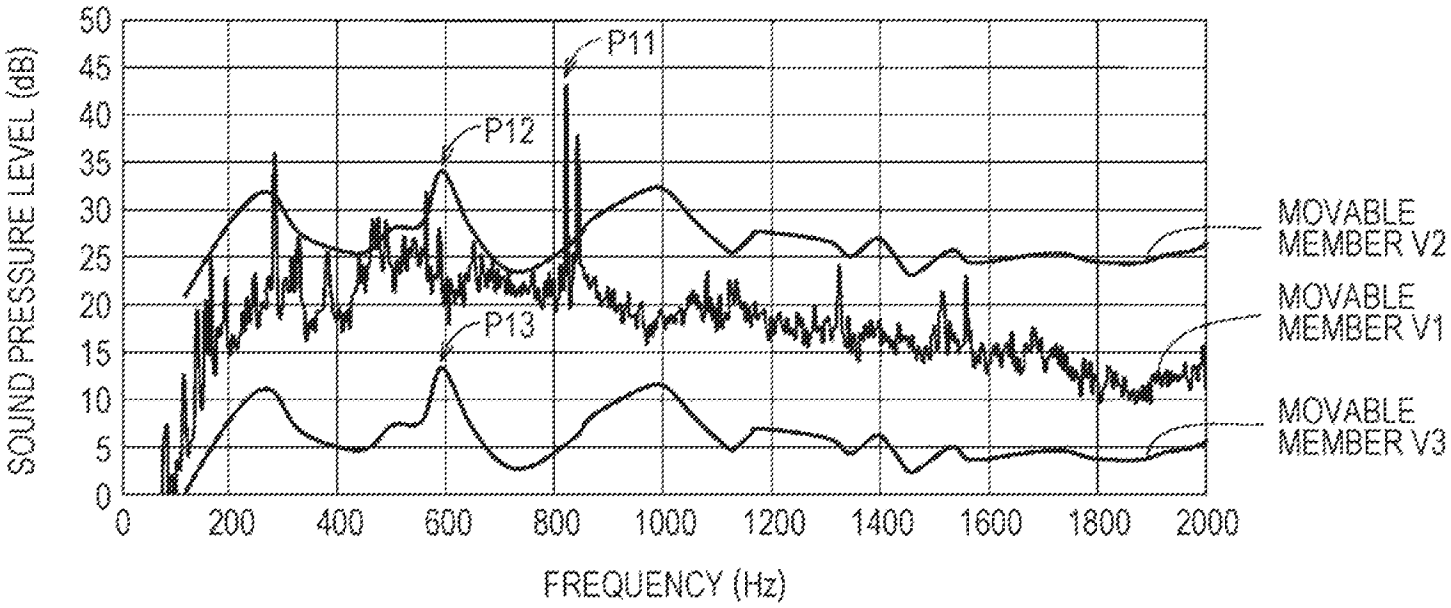
FIG. 12 is a schematic graph of the frequency characteristics of the normal sounds of operation of a plurality of movable members.

FIG. 12 is a schematic graph of the frequency characteristics of the normal sounds of operation of a plurality of movable members V1, V2, and V3.

With reference to FIGS. 2 and 12, for example, in a case where abnormality diagnosis is performed on the movable member V3 present at a far distance from the microphone 32 (e.g., the motor 52*a* in FIG. 2) and the movable member V1 present at a near distance from the microphone 32 (e.g., the motor 52*n* in FIG. 2), simultaneously, as illustrated in FIG. 12, because the sound pressure level of the sound of operation of the movable member V1 is higher than the sound pressure level of the sound of operation of the movable member V3, the sound of operation of the movable member V3 is buried in the sound of operation of the movable member V1 over the entire frequency. Thus, there is a tendency that the abnormality diagnosis on the movable member V3 is difficult to perform. In a case where abnormality diagnosis is performed on the movable member V3 in which the sound of operation is small and the movable member V2 in which the sound of operation is large, simultaneously, there is a tendency that the abnormality diagnosis on the movable member V3 is difficult to perform because of a similar reason.

Thus, according to a first modification, two movable members on which abnormality diagnosis is to be performed simultaneously, are extracted in consideration of the position of a movable member and the level of the sound of operation a movable member generates.

Specifically, as two movable members on which abnormality diagnosis is to be performed simultaneously, a combination of the movable member V1 and the movable member V2 is extracted. That is the sound pressure level of a peak P11 in the frequency characteristic of the normal sound of operation of the movable member V1 with the corresponding rotor being driven at the number of revolutions to be used in abnormality diagnosis, is higher than the sound pressure level at a frequency identical to that of the peak P11 in the frequency characteristic of the normal sound of operation the movable member V2 with the corresponding rotor being driven at the number of revolutions to be used in abnormality diagnosis. The sound pressure level of a peak P12 in the frequency characteristic of the normal sound of operation of the movable member V2 with the corresponding rotor being driven at the number of revolutions to be used in abnormality diagnosis, is higher than the sound pressure level at a frequency identical to that of the peak P12 in the frequency characteristic of the normal sound of operation of the movable member V1 with the corresponding rotor being driven at the number of revolutions to be used in abnormality diagnosis.

Second Modification

Figure 13:
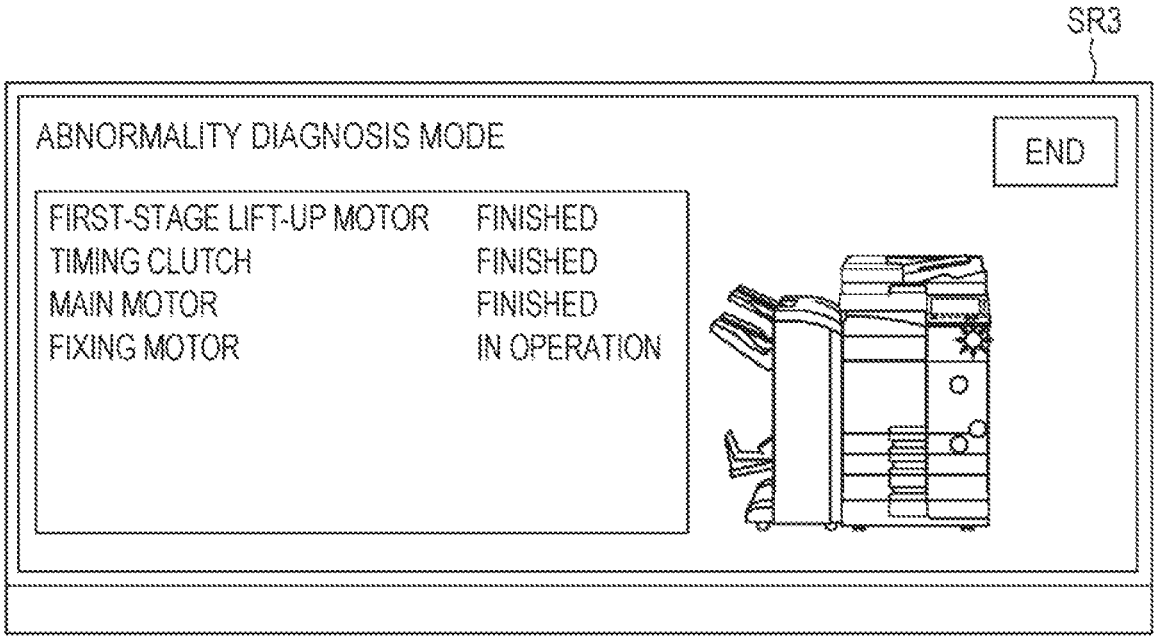
FIG. 13 is a schematic view of a screen to be displayed on the operation panel in performance of abnormality diagnosis on movable members in a second modification of the embodiment of the present invention.

FIG. 13 is a schematic view of a screen SR3 to be displayed on the operation panel 31 in performance of abnormality diagnosis on movable members in a second modification of the embodiment of the present invention.

With reference to FIG. 13, according to the second modification, parts at which movable members on which abnormality diagnosis is being performed are present, are displayed on the screen SR3. According to the second modification, in a case where a plurality of sets of two movable members on which abnormality diagnosis is to be performed simultaneously, is present, the CPU 101 performs abnormality diagnosis on each set of two movable members in sequence identical to the sequence of operation in printing in the normal mode.

From the screen SR3, it can be understood that abnormality diagnosis on the movable members is completed in the order of a first-stage lift-up motor (corresponding to the motor 52*c* of FIG. 2), a timing clutch (corresponding to the clutch 53*e* of FIG. 2), and a main motor (corresponding to the motor 52*b* of FIG. 2) from the upstream side to the downstream side in the conveyance direction of a sheet, and abnormality diagnosis on a fixing motor (corresponding to the motor 52*e* of FIG. 2) is being performed.

Performance of such a display notifies a user or the serviceman for the image forming apparatus 1 of the progress of abnormality diagnosis, so that a movable member having an abnormality can be grasped easily.

Note that, because the sheet feeding rollers 12 consume easier due to, for example, adhesion of paper powder, than the other members, in a case where a plurality of sets of two movable members on which abnormality diagnosis is to be performed simultaneously, is present, the CPU 101 may perform abnormality diagnosis on the sets including the movable members related to driving of the sheet feeding rollers 12 (clutches 53*a*, 53*c*, and 53*d* of FIG. 2) after diagnosing that no abnormality is present for the sets not including the movable members related to the sheet feeding rollers 12 (in this case, abnormality diagnosis stops in a case where an abnormality is detected in a set not including the movable members related to the sheet feeding rollers 12). This arrangement can avoid consumption of the sheet feeding rollers 12 due to driving for abnormality diagnosis, maximally.

Third Modification

FIG. 14 illustrates a printing history table stored in the ROM 103 in a third modification of the embodiment of the present invention.

With reference to FIGS. 2 and 14, according to the third modification, the ROM 103 stores the printing history table.

The printing history table is a table describing the operation history of the movable members on which abnormality diagnosis is to be performed. The printing history table describes the date and time of performed printing, the sheet feeding port used for printing (location at which sheets used for printing are housed), and the type and size of sheets used for printing.

In a case where extracting two movable members in the abnormality diagnosis mode, the CPU 101 specifies which of the two movable members is higher in frequency of operation, on the basis of the printing history table. In abnormality diagnosis, the CPU 101 sets the number of revolutions or speed of the rotor associated with the movable member higher in frequency of operation, at a value identical to that of the number of revolutions or speed in the normal mode, and drives the movable member.

Here, it is assumed that the first-stage lift-up motor (corresponding to the motor 52*c* of FIG. 2) and a second-stage lift-up motor (corresponding to the motor 52*d* of FIG. 2) are extracted. In this case, because a first-stage sheet feeding port is higher in frequency of operation than a second-stage sheet feeding port in the printing history table, the first-stage lift-up motor is higher in frequency of operation than the second-stage lift-up motor. Therefore, in abnormality diagnosis, the first-stage lift-up motor is driven at the number of revolutions in the normal mode and the second-stage lift-up motor is driven at a number of revolutions different from the number of revolutions in the normal mode (number of revolutions different from the number of revolutions of the first-stage lift-up motor).

According to the third modification, abnormality determination can be made with a movable member high in frequency of use, operating under a condition identical to that in the normal mode. Thus, improvement can be made in the reproducibility of occurrence of an abnormality of a movable member in abnormality diagnosis (e.g., a fault in revolution or an abnormal sound) and improvement can be made in the accuracy of detecting an abnormality. This arrangement enables completion of abnormality diagnosis in a short time, so that the working time of the serviceman can be shortened.

In the third modification, in a case where two movable members on which abnormality diagnosis is to be performed, are each a motor 52, the CPU 101 performs the following subroutine processing when performing the processing at step S27 in the flowchart of FIG. 10.

Figure 15:
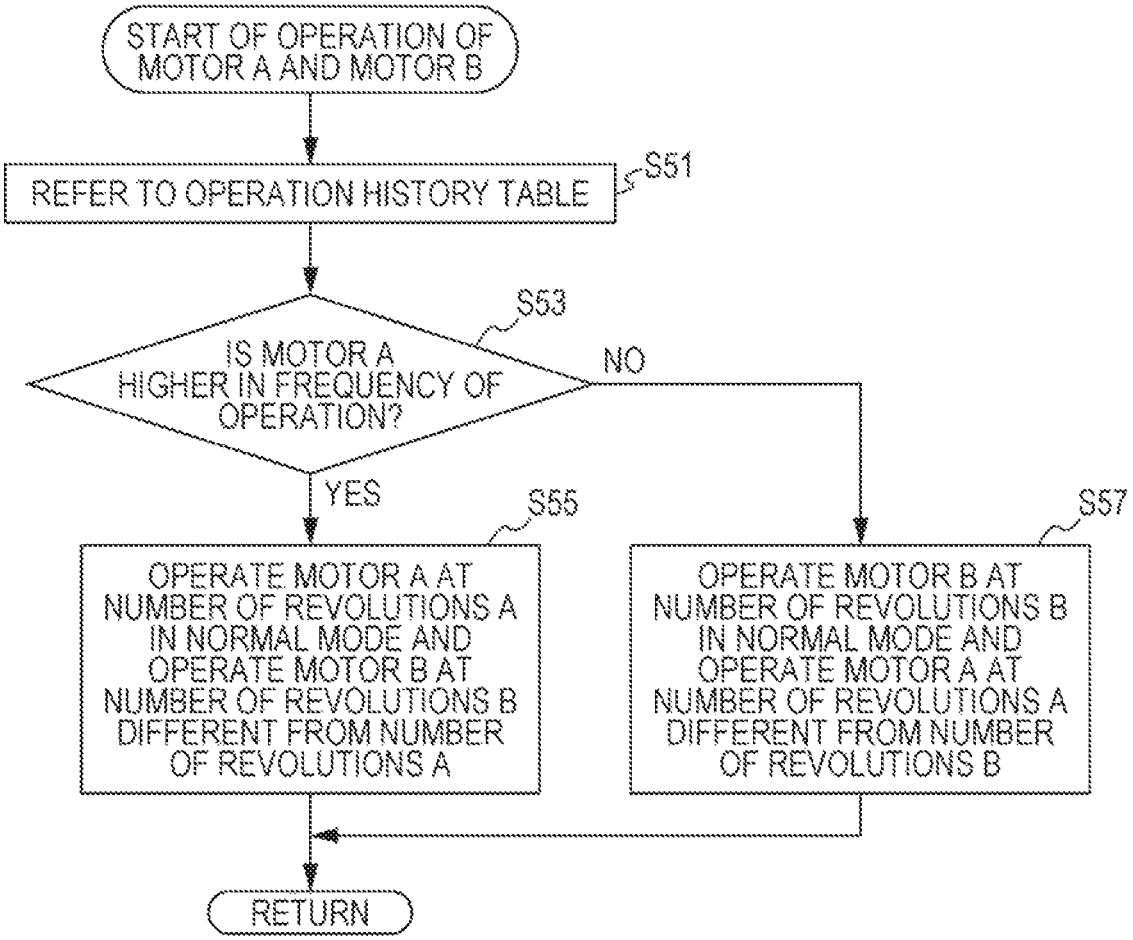
FIG. 15 is a subroutine at step S27 of FIG. 10 in the third modification of the embodiment of the present invention.

FIG. 15 is a subroutine at step S27 of FIG. 10 in the third modification of the embodiment of the present invention.

With reference to FIG. 15, the CPU 101 refers to the operation history table (S51), and determines whether the frequency of operation of the motor A is higher than the frequency of operation of the motor B (S53).

At step S53, in a case where determining that the frequency of operation of the motor A is higher than the frequency of operation of the motor B (YES at S53), the CPU 101 operates the motor A at the number of revolutions A in the normal mode and operates the motor B at the number of revolutions B different from the number of revolutions A (S55), and returns.

At step S53, in a case where determining that the frequency of operation of the motor A is not higher than the frequency of operation of the motor B (NO at S53), the CPU 101 operates the motor B at the number of revolutions B in the normal mode and operates the motor A at the number of revolutions A different from the number of revolutions B (S57), and returns.

Note that, in a case where two movable members on which abnormality diagnosis is to be performed, are each a fan 51, the CPU 101 performs processing similar to the subroutine above when performing the processing at step S7 in the flowchart of FIG. 8.

Fourth Modification

In a fourth modification, the image forming apparatus 1 and the mobile terminal 2 (exemplary abnormality diagnoser) perform mutual communication in the image forming system, to perform abnormality diagnosis on the movable members in the image forming apparatus 1. Note that it is assumed that the mobile terminal 2 is possessed by the user or the serviceman for the image forming apparatus 1.

Figure 16:
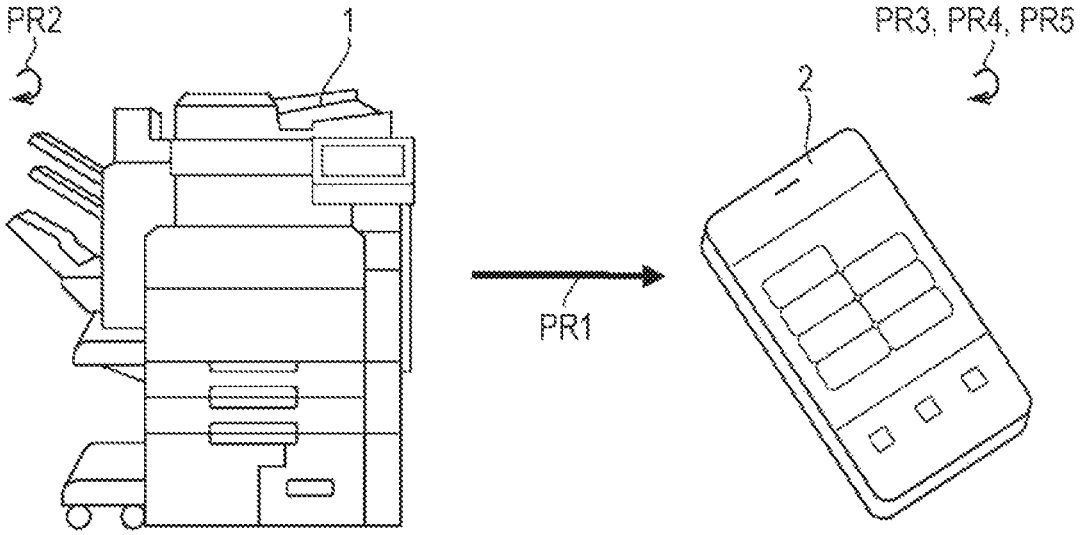
FIG. 16 is an explanatory illustration of abnormality diagnosis on movable members in the image forming apparatus, to be performed by the image forming system in a fourth modification of the embodiment of the present invention.

FIG. 16 is an explanatory illustration of abnormality diagnosis on the movable members in the image forming apparatus 1, to be performed by the image forming system in the fourth modification of the embodiment of the present invention.

With reference to FIG. 16, in a case where causing the operation mode to transition from the normal mode to the abnormality diagnosis mode in response to an instruction through, for example, the operation panel 31 or the mobile terminal 2, the CPU 101 of the image forming apparatus 1 transmits information regarding two movable members on which abnormality diagnosis is to be performed, to the mobile terminal 2 (processing PR1), and drives the two rotors corresponding to the two movable members on which abnormality diagnosis is to be performed (processing PR2).

After receiving the information regarding two movable members on which abnormality diagnosis is to be performed, from the image forming apparatus 1, the mobile terminal 2 makes a display of the effect that abnormality diagnosis starts, on the operation display 207, and starts sound collecting with the microphone 202 (processing PR3). The possessor of the mobile terminal 2 who has viewed the display of the effect that abnormality diagnosis starts, brings the mobile terminal 2 close to the image forming apparatus 1. This arrangement allows the microphone 202 to acquire the sounds of operation of the two movable members on which abnormality diagnosis is to be performed.

The mobile terminal 2 performs abnormality diagnosis on the two movable members, on the basis of the acquired sounds of operation and the peak information stored in the ROM 203 (processing PR4), and displays a result of the abnormality diagnosis on the operation display 207 (processing PR5). The mobile terminal 2 may transmit the result of the abnormality diagnosis to the image forming apparatus 1, and the image forming apparatus 1 may display the received result of the abnormality diagnosis, on the operation panel 31.

According to the fourth modification, the processing to be performed by the image forming apparatus 1 for abnormality diagnosis can be reduced, and the influence of abnormality diagnosis on other processing being performed by the image forming apparatus 1, can be reduced.

Effects of Embodiment

According to the embodiment described above, with two rotors corresponding to two movable members in the image forming apparatus 1, being driven at mutually different numbers of revolutions or speeds, simultaneously, the sounds of operation of the two movable members are acquired, and abnormality diagnosis is performed on the two movable members, on the basis of the acquired sounds of operation. This arrangement enables easy distinction between the respective sounds of operation that occur from the two movable members, and shortening of the time required for abnormality diagnosis on the movable members in the image forming apparatus 1. As a result, the time during which the image forming apparatus 1 stops for abnormality diagnosis, can shorten, so that the convenience of abnormality diagnosis can improve.

Others

The sequence of movable members on which abnormality diagnosis is to be performed, is arbitrary. With three rotors or more, as rotors corresponding to movable members, being driven at mutually different revolutions or speeds, simultaneously, the three movable members or more may be operated and the sounds thereof at the time may be collected with the microphone 32.

Instead of comparison between the sound pressure level and frequency at the peak of each of the acquired sounds of operation of two movable members and the peak information, the presence or absence of an abnormality may be diagnosed in comparison between the characteristic in a predetermined frequency range of each of the acquired sounds of operation of the two movable members and the characteristic in the predetermined frequency range of the sound of operation as a reference.

In a case where abnormality diagnosis is to be performed on a photoconductor 21 retaining an electrostatic latent image, the CPU 101 may drive the photoconductor at a speed slower than the speed of the photoconductor 21 in the normal mode, for a time shorter than the drive time of the photoconductor 21 in printing an image for one sheet in the normal mode. This arrangement can inhibit the photoconductor 21 from consuming due to abnormality diagnosis.

The processing in the embodiment described above, may be performed by software or by use of a hardware circuit. A program for performing the processing in the embodiment described above can be provided. The program recorded in a recording medium, such as a CD-ROM, a flexible disk, a hard disk, a ROM, a RAM, or a memory card, may be provided to a user. The program is executed by a computer, such as a CPU. The program may be downloaded to a device through a communication line, such as the Internet.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus comprising:

a first rotor and a second rotor that are each a rotatable member;

a first movable member including the first rotor or a first transferer that transfers power of the first rotor to another member;

a second movable member including the second rotor or a second transferer that transfers power of the second rotor to another member;

a sound acquirer configured to acquire sounds of operation of the first movable member and the second movable member with the first rotor and the second rotor being driven by the hardware processor; and a hardware processor that drives simultaneously the first rotor and the second rotor at mutually different numbers of revolutions per unit of time, and performs abnormality diagnosis on the first movable member and the second movable member, based on the sounds of operation acquired by the sound acquirer;

wherein the image forming apparatus has an operation mode including an abnormality diagnosis mode in which the abnormality diagnosis is to be performed on the first movable member and the second movable member and a normal mode in which the abnormality diagnosis is not to be performed on the first movable member and the second movable member, and the hardware processor sets, in the abnormality diagnosis mode, a number of revolutions per unit of time or the speed in the abnormality diagnosis mode of at least one rotor of the first rotor and the second rotor, differently from a number of revolutions per unit of time in the normal mode of the at least one rotor of the first rotor and the second rotor.

2. The image forming apparatus according to claim 1, further comprising a storage that stores a reference value of sound of operation, wherein the hardware processor performs the abnormality diagnosis on the first movable member and the second movable member in comparison between the sounds of operation acquired by the sound acquirer and the reference value.

3. The image forming apparatus according to claim 2, wherein the storage stores, as the reference value, information regarding a frequency of sound and a sound pressure level at a peak in a frequency characteristic of a sound of operation of each of the first movable member and the second movable member, and the hardware processor performs the abnormality diagnosis on the first movable member and the second movable member in comparison between frequency characteristics of the sounds of operation acquired by the sound acquirer and the information.

4. The image forming apparatus according to claim 3, wherein a sound pressure level of a first peak that is a peak in a frequency characteristic of a normal sound of operation of the first movable member with the first rotor being driven by the hardware processor, is higher than a sound pressure level at a frequency identical to a frequency of the first peak, in a frequency characteristic of a normal sound of operation of the second movable member with the second rotor being driven by the hardware processor, and a sound pressure level of a second peak that is a peak in the frequency characteristic of the normal sound of operation of the second movable member with the second rotor being driven by the hardware processor, is higher than a sound pressure level at a frequency identical to a frequency of the second peak, in the frequency characteristic of the normal sound of operation of the first movable member with the first rotor being driven by the hardware processor.

5. The image forming apparatus according to claim 3, wherein the storage further stores respective operation histories of the first movable member and the second movable member in the normal mode, and the hardware processor sets, in the abnormality diagnosis mode, based on the operation histories, the number of revolutions per unit of time of the rotor associated with a movable member higher in frequency of use from the first movable member and the second movable member, at a value identical to a value of the number of revolutions per unit of time in the normal mode of the rotor associated with the movable member higher in frequency of use.

6. The image forming apparatus according to claim 1, further comprising a receiver that receives an operation for a transition from the normal mode to the abnormality diagnosis mode.

7. The image forming apparatus according to claim 1, wherein the first movable member includes the first rotor that is a fan or a motor, and the second movable member includes the second rotor that is a fan or a motor.

8. The image forming apparatus according to claim 1, wherein the first movable member includes the first transferer that is a clutch or a solenoid that transfers the power of the first rotor to the another member, and the second movable member includes the second transferer that is a clutch or a solenoid that transfers the power of the second rotor to the another member.

9. The image forming apparatus according to claim 1, further comprising a display that displays a diagnosed result of the hardware processor.

10. The image forming apparatus according to claim 9, wherein a plurality of sets of the first movable member and the second movable member is provided, the hardware processor performs the abnormality diagnosis on the plurality of sets in sequence identical to sequence of operation of the plurality of sets in printing in a normal mode, and the display further displays a part at which each of the first movable member and the second movable member being diagnosed by the hardware processor, is present.

11. The image forming apparatus according to claim 9, wherein a plurality of sets of the first movable member and the second movable member is provided, and the hardware processor performs the abnormality diagnosis on a set including a movable member related to driving of a sheet feeding roller that feeds a sheet by rotation, after diagnosing that no abnormality is present for a set not including the movable member related to the sheet feeding roller.

12. The image forming apparatus according to claim 1, wherein the hardware processor drives, in a case where the first movable member is a photoconductor that retains an electrostatic latent image, the photoconductor at a speed slower than a speed of the photoconductor in a normal mode, for a time shorter than a drive time of the photoconductor in printing an image for one sheet in the normal mode.

13. An image forming system comprising:

an image forming apparatus; and an abnormality diagnoser, wherein the image forming apparatus and the abnormality diagnoser are each configured to perform mutual communication, the image forming apparatus includes:

a first rotor and a second rotor that are each a rotatable member;

a first movable member including the first rotor or a first transferer that transfers power of the first rotor to another member;

a second movable member including the second rotor or a second transferer that transfers power of the second rotor to another member;

a hardware processor that drives simultaneously the first rotor and the second rotor at mutually different numbers of revolutions per unit of time; and a transmitter that transmits, in a case where the hardware processor drives the first rotor and the second rotor, information regarding the first movable member and the second movable member, to the abnormality diagnoser, and the abnormality diagnoser includes:

a receiver that receives the information transmitted by the transmitter;

a sound acquirer that acquires sounds of operation of the first movable member and the second movable member after the receiver receives the information; and a hardware processor that is configured to perform abnormality diagnosis on the first movable member and the second movable member, based on the sounds of operation acquired by the sound acquirer;

wherein the image forming apparatus has an operation mode including an abnormality diagnosis mode in which the abnormality diagnosis is to be performed on the first movable member and the second movable member and a normal mode in which the abnormality diagnosis is not to be performed on the first movable member and the second movable member, and the hardware processor sets, in the abnormality diagnosis mode, a number of revolutions per unit of time or the speed in the abnormality diagnosis mode of at least one rotor of the first rotor and the second rotor, differently from a number of revolutions per unit of time in the normal mode of the at least one rotor of the first rotor and the second rotor.

14. The image forming system according to claim 13, wherein the abnormality diagnoser is a mobile terminal.

15. A non-transitory recording medium storing a computer readable control program of an image forming apparatus including: a first rotor and a second rotor that are each a rotatable member; a first movable member including the first rotor or a first transferer that transfers power of the first rotor to another member; and a second movable member including the second rotor or a second transferer that transfers power of the second rotor to another member, the control program causing a computer to perform:

driving simultaneously the first rotor and the second rotor at mutually different numbers of revolutions per unit of time;

acquiring sounds of operation of the first movable member and the second movable member with the first rotor and the second rotor being driven by the driving; and performing abnormality diagnosis on the first movable member and the second movable member, based on the sounds of operation acquired by the acquiring;

wherein the image forming apparatus has an operation mode including an abnormality diagnosis mode in which the abnormality diagnosis is to be performed on the first movable member and the second movable member and a normal mode in which the abnormality diagnosis is not to be performed on the first movable member and the second movable member, and the hardware processor sets, in the abnormality diagnosis mode, a number of revolutions per unit of time or the speed in the abnormality diagnosis mode of at least one rotor of the first rotor and the second rotor, differently from a number of revolutions per unit of time in the normal mode of the at least one rotor of the first rotor and the second rotor.

* * * * *